US006074811A

United States Patent [19]

Saitou

[11] Patent Number: 6,074,811

[45] Date of Patent: Jun. 13, 2000

[54] SILVER HALIDE EMULSION

[75] Inventor: Mitsuo Saitou, Kanagawa, Japan

[73] Assignee: Fuji Photo Film Co., Ltd., Kanagawa, Japan

[21] Appl. No.: 09/234,108

[22] Filed: Jan. 19, 1999

[30] Foreign Application Priority Data

Jan. 20, 1998 [JP] Japan ..... 10-009124
Apr. 20, 1998 [JP] Japan ..... 10-123878

[51] Int. Cl.[7] ..... G03C 1/035; G03C 1/04; G03C 1/043; G03C 1/053

[52] U.S. Cl. ..... 430/567; 430/569; 430/603; 430/636; 430/637

[58] Field of Search ..... 430/567, 569, 430/603, 636, 637

[56] References Cited

U.S. PATENT DOCUMENTS

| | | | |
|---|---|---|---|
| 5,604,084 | 2/1997 | Grzeskowiak et al. | 430/567 |
| 5,759,759 | 6/1998 | Adin et al. | 430/567 |
| 5,773,207 | 6/1998 | Barcock et al. | 430/567 |
| 5,807,664 | 9/1998 | Suzuki | 430/567 |
| 5,807,665 | 9/1998 | Saitou | 430/569 |

FOREIGN PATENT DOCUMENTS

| | | | |
|---|---|---|---|
| 0 534 395 | 3/1993 | European Pat. Off. | G03C 1/005 |

*Primary Examiner*—Mark F. Huff

*Attorney, Agent, or Firm*—Sughrue, Mion, Zinn, Macpeak & Seas, PLLC

[57] ABSTRACT

A silver halide emulsion is described, which comprises at least a dispersion medium and silver halide grains, wherein from 40 to 100% of the total projected area of the entire silver halide grains are occupied by tabular grains having a thickness of from 0.01 to 0.50 $\mu$m, an aspect ratio (diameter/thickness) of from 1.6 to 500, and main planes of {100} faces, and the aspect ratio of a right angled parallelogram surrounded by edge sides of {100} face of the tabular grains or a right angled parallelogram formed by extending the edge sides (long side length/short side length) is from 1 to 8, and the tabular grains are tabular grains formed by the adsorption of compound $A^0$ represented by formula ($Z^1$), ($Z^2$), ($Z^3$) or ($Z^4$) onto silver halide grains:

$$B^1—S—B^2 \quad (Z^1)$$

$$B^1—S(O)—B^2 \quad (Z^2)$$

$$B^1—S(O_2)—B^2 \quad (Z^3)$$

$$B^1—S^+(R^0)—B^2 \cdot Y_0^- \quad (Z^4)$$

wherein $B^1$ represents a residue having two or more repeating units of polyvinyl alcohol in $B^1$; —S— represents a thioether group; $B^2$ represents a residue having two or more repeating units of polyacrylic acid or polyacrylamide; $R^0$ represents an alkyl group having from 1 to 20 carbon atoms, an aryl group, or an amino group; and $Y_0^-$ represents an anion.

3 Claims, 3 Drawing Sheets

SILVER HALIDE EMULSION

FIELD OF THE INVENTION

The present invention relates to a silver halide (hereinafter referred to as "AgX") emulsion useful in the field of photography, in particular, a silver halide emulsion excellent in sensitivity, image quality and storage stability.

BACKGROUND OF THE INVENTION

When tabular AgX emulsion grains are used in a photographic material, as compared with nontabular AgX grains, the ratio of incident light passing through a sensitive layer without stopping is reduced, trapping effect of light is increased, and image quality (covering power, sharpness, graininess), rate of development and spectral sensitization characteristics are improved. In particular, these effects are extremely marked with tabular grains having {100} main planes. These {100} tabular grains are disclosed in JP-A-51-88017 (the term "JP-A" as used herein means an "unexamined published Japanese patent application"), JP-B-64-8323 (the term "JP-B" as used herein means an "examined Japanese patent publication"), JP-A-5-281640, JP-A-5-313273, JP-A-6-59360, JP-A-6-324446, JP-A-8-339044, EP-A-0534395, U.S. Pat. Nos. 5,292,632, 5,314,798 and 5,264,337. The present invention is to provide more excellent {100} tabular grain emulsion compared to conventional {100} tabular grains. Conventional {100} tabular grains have crystal defects which makes it possible to preferentially grow in the edge direction, therefore, grains grow to tabular grains. However, shape characteristics and photographic characteristics of grains to be formed largely differ by the defect forming methods. Shape characteristics and photographic characteristics of grains to be formed also largely differ by growing methods of grains. Therefore, the improvements of the methods of forming defects and the growing methods have attracted public attention. EP-A-0534395 discloses a method of forming tabular grains in the presence of an adsorbent which accelerates the formation of {100} faces, but grains having satisfactory shape and photographic properties cannot be obtained according to this method.

SUMMARY OF THE INVENTION

An object of the present invention is to provide an AgX emulsion exhibiting low fog density and excellent sensitivity and graininess.

The above object of the present invention has been attained by the following means.

(I-1)

1. A silver halide emulsion comprising at least a dispersion medium and silver halide grains, wherein from 40 to 100% of the total projected area of the entire silver halide grains are occupied by tabular grains having a thickness of from 0.01 to 0.50 μm, an aspect ratio (diameter/thickness) of from 1.6 to 500, and main planes of {100} faces, and the aspect ratio of a right angled parallelogram surrounded by edge sides of {100} face of the tabular grains or a right angled parallelogram formed by extending the edge sides (long side length/short side length) is from 1 to 8, and the tabular grains are tabular grains formed by the adsorption of compound AO represented by formula ($Z^1$), ($Z^2$), ($Z^3$) or ($Z^4$) onto silver halide grains:

$$B^1—S—B^2 \quad (Z^1)$$

$$B^1—S(O)—B^2 \quad (Z^2)$$

$$B^1—S(O_2)—B^2 \quad (Z^3)$$

$$B^1—S^+(R^0)—B^2 \cdot Y_0^- \quad (Z^4)$$

wherein $B^1$ represents a residue having two or more repeating units of polyvinyl alcohol in $B^1$; —S— represents a thioether group; $B^2$ represents a residue having two or more repeating units of polyacrylic acid or polyacrylamide; $R^0$ represents an alkyl group having from 1 to 20 carbon atoms, an aryl group, or an amino group; and $Y_0^-$ represents an anion.

The preferred embodiments are described below.

2. The silver halide emulsion as described in the above item 1, wherein the seed crystals of the tabular grains are formed by feeding $Ag^+$ and a halogen ion to the aqueous solution containing silver halide grains adsorbed compound $A^0$ and growing the grains.

3. The silver halide emulsion as described in the above item 1, wherein the tabular grains are formed in a silver halide emulsion containing at least gelatin, water and silver halide grains adsorbed with compound $A^0$, and $x_1$ (the weight of compound $A^0$/the weight of the dispersion medium) in the emulsion is from $10^{-3}$ to 100.

Key to the Symbols

Figure 1:
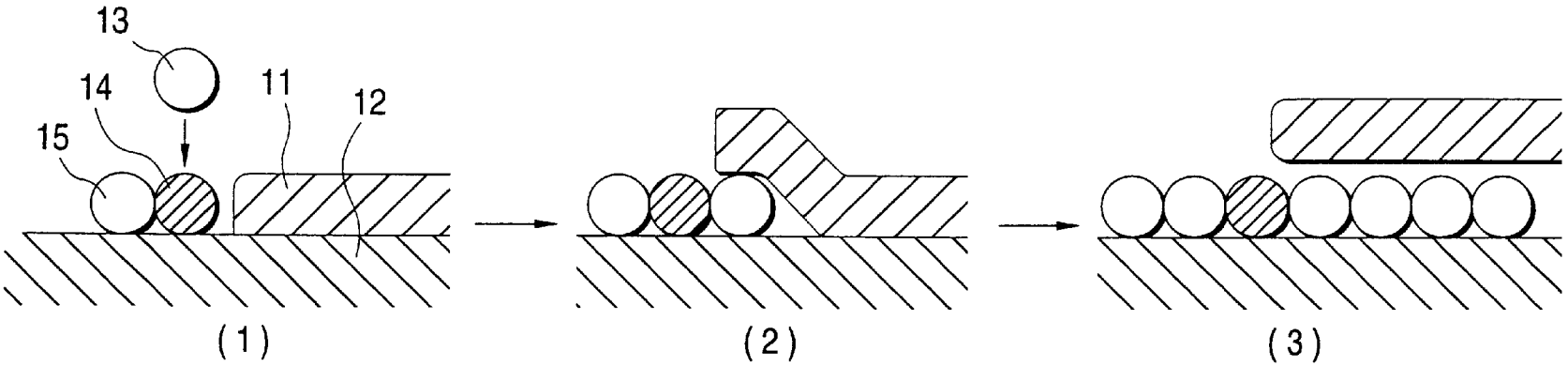
FIGS. 1(*a*) and (*b*) show a model of growth acceleration mechanism of edge faces of tabular grains.
Figure 1:
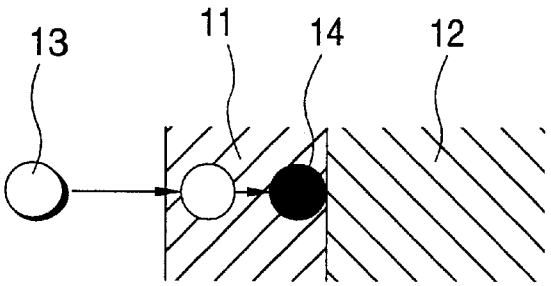

11: Absorption phase of compound $A^0$
12: AgX phase
13: Solute ion in solution
14: Stable nucleus of growing layer
15: Solute ion of growing layer
31: Viscosity of mixed solution

DETAILED DESCRIPTION OF THE INVENTION

The present invention is described in detail below.

(I-2) AgX Emulsion

From 40 to 100%, preferably from 60 to 100%, more preferably from 90 to 100%, and still more preferably from 95 to 100% of the total projected area of the entire AgX grains in the AgX emulsion according to the present invention are tabular grains having main planes of {100} faces; a thickness of from 0.01 to 0.50 μm, preferably from 0.02 to 0.30 μm, and more preferably from 0.02 to 0.10 μm; an aspect ratio (diameter/thickness) of from 1.6 to 500, preferably from 2.0 to 300, and more preferably from 3.0 to 100; and a projected area diameter of from 0.05 to 20 μm, and preferably from 0.1 to 10 μm. A variation coefficient of projected area diameter and thickness (standard deviation of distribution/average value) of the grains is preferably from 0 to 0.4, more preferably from 0 to 0.3, and still more preferably from 0.01 to 0.2. Here the projected area diameter means the diameter of the circle having the same area as the projected area of the grain, and the thickness means the distance between two main planes of the tabular grain. The projected area diameter of the tabular grain means the diameter of the circle having the same area as the projected area of the grain when main planes are placed in parallel with the substrate plane and observed from the vertical direction.

The tabular grains having {100} main planes are classified into the following nine criteria by their shapes. (1) A grain the shape of the main plane of which is a right angled parallelogram, and the aspect ratio (long side length/short side length) of the right angled parallelogram in one tabular grain is from 1 to 8, preferably from 1 to 4, and more preferably from 1 to 2, (2) a grain in which one or more, preferably from one to three, of four corners of the right angled parallelogram is (are) lacking non-equivalently [i.e., a grain having $x_2$ (the area of the largest lacking part/the area of the smallest lacking part) of from 1.5 to infinity, preferably from 2 to infinity], (3) a grain in which four corners of the right angled parallelogram are lacking equivalently (a grain having $x_2$ of less than 2), (4) a grain in which from 5 to 100%, preferably from 20 to 100%, of the area of the edge faces of the lacking parts are {111} planes, (5) a grain in which at least two opposite sides of four edge sides constituting the outline of the projected shape of the tabular grain contour a convex curve toward the outside, (6) a grain in which one or more, preferably from one to three, of four corners of the right angled parallelogram is (are) lacking in the state of right angled parallelogram, (7) a grain in which from 0.1 to 100%, preferably from 5 to 50%, of the area of the edge faces of the tabular grain are {n10} faces, wherein n is from 1 to 5, preferably 1, (8) a tabular grain the corners of which are rounded in the above items (1) to (4), and (9) a grain in which $X_6$ (the total of the lengths of straight line portions of each side/the total of the lengths of each side of the right angled parallelogram formed by extending straight line portions) is from 0.01 to 1.0, preferably from 0.3 to 9.90, in the above item (1).

The average halogen composition of the entire tabular grains is not particularly restricted and every composition can be used, but the $I^-$ content is preferably from 0 to 20 mol %, more preferably from 0 to 10 mol %. The halogen composition of the tabular grains according to the present invention may be AgCl, AgBr, AgBrI, AgClI and mixed crystals of these.

The AgBr content is preferably from 60 to 100 mol %, more preferably from 85 to 100 mol %, and most preferably from 90 to 100 mol %.

The structure of the halogen composition of the inside of the grains is (1) a uniform structure type, or (2) a core/shell structure type. Grains in which core and shell parts comprise different halogen compositions may be also used. The AgX mol ratio of the core/shell here may be any ratio, preferably from $10^{-5}$ to $10^5$, more preferably from $10^{-3}$ to $10^3$, and still more preferably from $10^{-2}$ to $10^2$. Further, Multi-structural grains having a core and two or more shell layers may be used, and the description as to grain structures of these grains disclosed in JP-A-5-281640, JP-A- 6-59360, JP-A-5-313273 and JP-A-7-234470 can be referred to. It is preferred that the halogen composition among each layer should mutually differ by 0.1 to 100 mol %, preferably from 1 to 90 mol %, and more preferably from 10 to 80 mol %, in terms of $Cl^-$ content or $Br^-$ content, further, mutually differ by 0.1 to 40 mol %, preferably from 3 to 20 mol %, in terms of $I^-$ content. Moreover, it is also possible to cover the grain surface with different AgX layers (AgCl, AgBr, AgI, AgSCN, silver phosphate and mixed crystals of two or more of these in every ratio) in 0.1 to 1,000 atomic layer content, preferably from 0.5 to 100 atomic layer content.

The distribution of the contents of these AgX and the surface layer thickness are substantially uniform on the grain surfaces and among grains. "Substantially uniform" used herein means that the variation coefficient of the content distribution (standard deviation/average content) is preferably from 0 to 0.4, more preferably from 0 to 0.2, and more preferably from 0 to 0.1.

In addition, an embodiment of grains of nonuniform distribution on the grain surface (variation coefficient>0.4) can be exemplified. In particular, grains whose edge part, corner part and the vicinity thereof is swollen can be exemplified, and for example, U.S. Pat. No. 5,275,930 can be referred to.

These grains are formed as edge faces selectively grow compared to main planes. The anisotropic growth results from the adsorption of compound $A^0$ represented by formula ($Z^1$), ($Z^2$), ($Z^3$) or ($Z^4$) onto AgX grains, further results from the deposition of $Ag^+$ and $X^-$ on the compound $A^0$-adsorbed AgX grains. In the present invention grains having isotropic growing capability is called tabular grains having isotropic growing defects.

(I-3) Explanation of Compound $A^0$ (A1) Explanation of Compound Represented by Formula ($Z^1$)

Compound $A^0$ is represented by formula ($Z^1$), ($Z^2$), ($Z^3$) or ($Z^4$), wherein $B^1$ contains 2 or more, preferably from 4 to $10^5$, more preferably from 10 to $10^4$, polyvinyl alcohol (hereinafter referred to as "PVA") repeating units (hereinafter referred to as "VAU") in $B^1$. $B^1$ is synthesized by polymerizing two or more molecules of polymerizable ethylenically unsaturated monomers, and $B^1$ is generally saponified after being polymerized by radical polymerization with vinyl ester represented by formula (2) shown below and synthesized by converting the ester group to an alcohol group, wherein $R^1$ represents H or an alkyl group having from 1 to 8 carbon atoms, and $R^2$ represents H or an alkyl group having from 1 to 20 carbon atoms.

The content ratio of VAU represented by formula (3) shown below and vinyl ester unit (hereinafter referred to as "VEU") represented by formula (4) shown below in $B^1$ is varied according to the saponification degree. $X_3$ [VAU number/(VEU number+VAU number)]=saponification degree is from 0.5 to 1.0, preferably from 0.7 to 1.0, and more preferably from 0.9 to 1.0. It is essential that Bi should contain VAU, but constitutional units other than VAU and VEU may be contained. In this case, it is essential that $X_4$ (VAU number/all constitutional unit number in $B^1$) should be from 0.5 to 1.0, more preferably from 0.7 to 1.0, and still more preferably from 0.9 to 1.0. When $X_4$ is not 1.0, the compound is formed by copolymerization of a polymerizable ethylenically unsaturated monomer represented by formula (5) or (6) shown below and a compound represented by formula (2). $R^2$, $R^3$ and $R^4$, which may be the same or different, each represents a group which can be substituted.

$Y_0^-$ represents an anion, specifically an acid radical such as a halogen ion, a hydroxyl group or $NO_3^-$ can be exemplified.

(2)

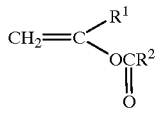

-continued (3)

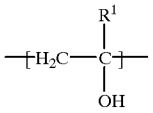

(4)

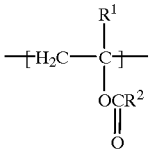

(5)

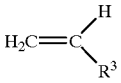

(6)

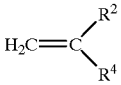

(7)

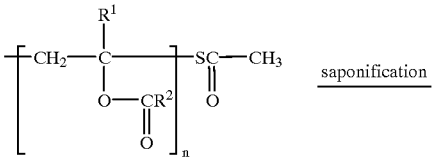

saponification (A¹)

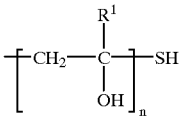

(A²)

Examples of groups which can be substituted include a halogen atom (e.g., fluorine, chlorine, bromine), an alkyl group (e.g., methyl, ethyl, n-propyl, isopropyl, t-butyl, n-octyl, cyclopentyl, cyclohexyl), an alkenyl group (e.g., allyl, 2-butenyl, 3-pentenyl), an alkynyl group (e.g., propargyl, 3-pentynyl), an aralkyl group (e.g., benzyl, phenethyl), an aryl group (e.g., phenyl, naphthyl, 4-methylphenyl), a heterocyclic group (e.g., furyl, imidazolyl, piperidyl, morpholino), an alkoxyl gorup (e.g., methoxy, ethoxy, butoxy), an aryloxy group (e.g., phenoxy, 2-naphthyloxy), an amino gorup (e.g., unsubstituted amino, dimethylamino, ethylamino, anilino), an acylamino gorup (e.g., acetylamino, benzoylamino), a ureido group (e.g., unsubstituted ureido, N-methylureido, N-phenylureido), a urethane group (e.g., methoxycarbonylamino, phenoxycarbonylamino), a sulfonylamino group (e.g., methylsulfonylamino, phenylsulfonylamino), a sulfamoyl group (e.g., unsubstituted sulfamoyl, N,N-dimethylsulfamoyl, N-phenylsulfamoyl), a carbamoyl group (e.g., unsubstituted carbamoyl, N,N-diethylcarbamoyl, N-phenylcarbamoyl), a sulfonyl group (e.g., mesyl, tosyl), a sulfinyl group (e.g., methylsulfinyl, phenylsulfinyl), an alkyloxycarbonyl gorup (e.g., methoxycarbonyl, ethoxycarbonyl), an aryloxycarbonyl group (e.g., phenoxycarbonyl), an acyl group (e.g., acetyl, benzoyl, formyl, pivaloyl), an acyloxy group (e.g., acetoxy, benzoyloxy), a phosphoric acid amido group (e.g., N,N-diethyl phosphoric acid amido), an alkylthio group (e.g., methylthio, ethylthio), an arylthio group (e.g., phenylthio), a cyano group, a sulfo group, a carboxyl group, a phosphono group, a nitro group, a sulfino group, an ammonio group (e.g., trimethylammonio), a phosphonio group, and a hydrazino group. These groups may further be substituted.

Specific examples of copolymerizable ethylenically unsaturated monomers include the following: (1) monomers having an anionic group or salts thereof (e.g., metal salts, ammonium salts), e.g., acrylic acid, methacrylic acid, itaconic acid, vinyl benzoic acid, styrenesulfonic acid, maleic acid, fumaric acid, styrenesulfinic acid, phosphonoxyethyl acrylate, and 2-acrylamidopropanesulfonic acid; (2) monomers having a cationic group, e.g., methacrylamidopropyltrimethylammonium chloride, and N,N,N-trimethyl-N-3-acrylamidopropylammonium chloride; and (3) nonionic ethylenically unsaturated monomers, e.g., ethylene, propylene, methyl vinyl ketone, aliphatic acid monoethylenically unsaturated ester (e.g., vinyl acetate, allyl acetate), ethylenically unsaturated monocarboxylate or dicarboxylate (e.g., methacrylate), ethylenically unsaturated monocarboxylic acid amido (e.g., t-butylacrylamido), monoethylenically unsaturated compounds (e.g., acrylonitrile, methacrylonitrile), and dienes (e.g., butadiene, isoprene).

In formulae ($Z^1$), ($Z^2$), ($Z^3$) and ($Z^4$), —S— represents a thioether group. The main component of $B^2$ is an acrylic polymer ($a_1$) having an ionic group or an acrylamide polymer ($a_2$) having incorporated therein an ionic group. "Main component" herein means that the total weight percent of these polymers in $B^2$ accounts for from 30 to 100 wt %, preferably from 60 to 100 wt %, and still more preferably from 80 to 100 wt %.

($a_1$) is formed by homopolymerization or copolymerization of acrylic ionic monomers, e.g., acrylic acid, methacrylic acid, 2-acrylamidopropanesulfonic acid, metal salts and ammonium salts of them, dimethylaminoethyl acrylate, and acrylamidopropyltrimethylammonium chloride. ($a_2$) is a copolymer of these ionic monomers and the above-described nonionic monomers. of these ionic monomers, monomers containing a carboxyl group such as acrylic acid and methacrylic acid and salts thereof, or monomers containing the above sulfonic acid groups or salts thereof are particularly preferred. Further, of the above nonionic monomers, acrylamide, methacrylamide, N,N-dimethylacrylamide and N-vinylpyrrolidone are particularly preferred.

The amount of the ionic group in the above-described $a_2$ is preferably from 1.0 to 100 mol %, more preferably from 30 to 100 mol %, and still more preferably from 70 to 100 mol %. (The weight of $B^2$/the total weight) in the compound $A^0$ molecule is preferably from 0.001 to 0.80, more preferably from 0.01 to 0.50, and still more preferably from 0.02 to 0.30. Compound $A^0$ is a water-soluble or water-dispersible block copolymer. It is particularly preferred that from 50 to 100 mol %, more preferably from 75 to 100 mol %, of the ionic groups in $B^2$ are constitutional units of polyacrylic acid or salts thereof.

$B^2$ contains 2 or more, preferably from 2 to $10^5$, more preferably from 4 to $10^4$ repeating units of polyacrylic acid or polyacrylamide. $B^2$ preferably contains 2 or more, more preferably from 2 to $10^5$, and still more preferably from 4 to $10^4$, repeating units of polyacrylic acid.

It is preferred to produce compound $A^0$ by radical polymerization of a monomer having an ionic group in the presence of $A^2$ having a mercapto group at terminals, $A^2$ is obtained by saponification of a polyvinyl ester polymer $A^1$ having a thiolic ester group at terminals.

$A^2$ is obtained by saponification of a polyvinyl ester polymer $A^1$ by ordinary methods, $A^1$ is obtained by polymerization of a vinyl monomer comprising vinyl ester monomers as a main component in the presence of a thiolic acid. The alteration of only the main moiety of the molecule at that time is represented by formula (7). The thiolic acid used here is preferably an organic thiolic acid having a —COSH group, specifically thiolacetic acid, thiolpropionic acid, thiolbutyric acid, and thiolvaleric acid can be exemplified as examples thereof, and thiolacetic acid is more preferably used. The addition amount and the method of addition of thiolic acid are not particularly restricted and the optimal amount can be used selectively according to purposes.

Specific examples of the vinyl esters include vinyl formate, vinyl acetate, vinyl propionate, vinyl laurate, and vinyl stearate, and vinyl acetate is more preferably used. Polymerization can be conducted in the presence of a radical polymerization initiator by any of a block polymerization method, a solution polymerization method, a pearl polymerization method, and an emulsion polymerization method, but a solution polymerization method using methanol as a solvent is preferred. Well-known processes such as a batch type process, a semi-continuous type process or continuous type process can be used as polymerization process.

Well-known radical polymerization initiators can be used as a polymerization initiators, such as 2,2'-azobisisobutyronitrile, benzoyl peroxide, or carbonate peroxide, and azo-based initiators such as 2,2'-azobisisobutyronitrile are more preferred. Radiation (i.e., radiation ray) and electron beams can also be used. After polymerization has been conducted for a prescribed time, vinyl esters not polymerized are removed by ordinary methods, thereby thiolic ester-terminated $A^2$ can be obtained.

$A^1$ can be obtained by saponifying $A^2$ by ordinary methods. An alcohol solution is preferred as a saponification solution and a methanol solution is more preferred. Temperature of saponification is preferably from 5 to 80° C. An an alkali catalyst, e.g., NaOH, KOH, Na-methylate or K-methylate is preferably used as a catalyst for saponification. The addition amount of the catalyst is preferably from 0.001 to 0.3, more preferably from 0.002 to 0.2, in molar ratio based on the vinyl ester unit.

Polymer terminals alter to mercapto groups and the main chain alters to a vinyl alcohol by this saponification reaction. The $x_1$ value can be selected by selecting the degree of a saponification reaction. Polymers precipitated by a saponification reaction are purified by well-known methods (e.g., washing with methanol) to remove unnecessary substances, dried, thereby Al can be obtained as a white powder, in general.

The block copolymer $A^0$ (i.e., polymer of formula $Z^1$) is obtained by radical polymerization of a monomer having an ionic group in the presence of $A^1$. The polymerization is preferably carried out using a usual radical polymerization initiator, e.g., 2,2'-azobisisobutyronitrile, benzoyl peroxide, lauroyl peroxide, diazopropyl peroxycarbonate, potassium persulfate, ammonium persulfate, etc. Potassium bromate is particularly preferred as it does not generate radicals by itself under a usual polymerization condition and is decomposed only by the redox reaction with the mercapto group at terminals of PVA and generates radicals.

When the polymerization system is basic, the mercapto group is tonically added to the double bond of the monomer and vanishes rapidly, therefore, the rate of polymerization is markedly reduced. Accordingly, it is preferred that the polymerization system be acidic, i.e., pH of the aqueous system is preferably 5 or less, more preferably from 1 to 4.

With respect to these, details are disclosed in JP-A-60-240763, JP-A-59-187003 and JP-A-59-189113.

The variation coefficient of the molecular weight distribution (standard deviation of the molecular weight distribution by weight/weight average molecular weight) of compound $A^0$ is preferably from 0.01 to 0.60, more preferably from 0.02 to 0.40, and still more preferably from 0.02 to 0.20. As an example of compound $A^0$ having the narrow distri-bution, a divided product by ultrafiltration can be exemplified.

Compound $A^0$ is excellent in view of being a block copolymer. The characteristics of PVA in $B^1$ are not impaired and the characteristics are well modified by the characteristics of the $B^2$ moiety and the thioether group and the characteristics of the present invention are induced. There is a method of using a random copolymer of the $B^1$ moiety and $B^2$ moiety copolymerized from the first, but in such a case, as the characteristics of $B^1$ are impaired, this method is inferior to the method of the present invention.

As a representative example of compound $A^0$, a compound represented by formula (8) (a compound in which $B^1$ represents a polyvinyl alcohol residue and $B^2$ represents a polyacrylic acid residue) can be exemplified. Examples of the polymerization degrees of $B^1$ and $B^2$ are shown in Table 1. Compounds 2 to 5, 7 and 8 are the compounds according to the present invention. With respect to the producing methods of these compounds, JP-A-59-187003 and JP-A-59-189113 can be referred to.

The stereostructure of the $B^1$ moiety and the $B^2$ moiety is a weight ratio of (weight of syndiotactic structure/weight of isotactic structure/weight of atactic structure), and each ratio can be selected from every ratio of from 0 to 1.0.

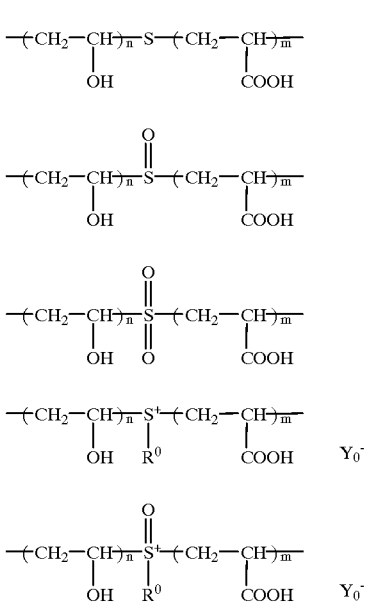

TABLE 1

| Compound No. | Average Polymerization Degree of PVA in $B^1$/ Percent by Weight | Percent by Weight of PAA in $B^2$ |
|---|---|---|
| 1 | 1,700/100 | 0 |
| 2 | 1,700/90 | 10 |
| 3 | 1,700/80 | 20 |

TABLE 1-continued

| Compound No. | Average Polymerization Degree of PVA in $B^1$/ Percent by Weight | Percent by Weight of PAA in $B^2$ |
|---|---|---|
| 4 | 1,700/70 | 30 |
| 5 | 1,000/90 | 10 |
| 6 | 500/100 | 0 |
| 7 | 500/90 | 10 |
| 8 | 500/80 | 20 |

Concerning synthesis methods, kinds of copolymers, molecular structures, and characteristics of the $B^1$ moiety and $B^2$moiety, compounds described in the following literature can be referred to: Koichi Nagano, et al., *Poval*, published by Kobunshi-Kankokai (1970), Kazuo Yamaura, et al., *Polyvinyl Alcohol*, published by Kobunshi-Kankokai (1991), compiled by Poval-Kai, *The World of PVA*, published by Kobunshi-Kankokai (1992), compiled by Finch, *Polyvinyl Alcohol Development*, John Wiley & Sons (1992), JP-A-8-339044, JP-A-3-109539, JP-A-4-226449, JP-A-6-19029, JP-A-59-187003, JP-A-59-189113, *Shin-Jikken Kagaku Koza* 19, *Kobunshi Kagaku* [I] (*New Experimental Chemistry Course* 19, *Chemistry of High Polymer* [I], Maruzen Co., Ltd. (1978), and *Jikken Kagaku Koza* 28, 29 (*Experimental Chemistry Course* 28, 29), 4th Ed., Maruzen Co., Ltd. (1992).

(A2) Explanation of Compounds Represented by Formulae ($Z^2$) and ($Z^3$)

A compound represented by formula ($Z^2$) is a sulfinylated compound of a compound represented by formula ($Z^1$) and is represented by formula (9), and a compound represented by formula ($Z^3$) is a sulfonylated compound of a compound represented by formula ($Z^1$) and is represented by formula (10). Each of them can be obtained by oxidizing a compound represented by formula ($Z^1$). If a compound of formula $Z^1$ is oxidized in a weak oxidation condition, a compound of formula $Z^2$ can be obtained in a high yield and if oxidized in a strong oxidation condition, a compound of formula $Z^3$ can be obtained in a high yield. A strong oxidation condition means that an oxidation reaction is carried out in a strong oxidation condition using a large amount of a strong oxidizing agent. A strong oxidizing agent is a compound the aqueous solution of which has a standard electrode potential ($V_1$ volt) of preferably from 0.5 to 3.0, more preferably from 0.8 to 2.8, and most preferably from 1.0 to 2.5. The addition amount of a strong oxidizing agent is preferably from 0.4 to 10 times, more preferably from 0.8 to 10 times, of the existing mol amount of $Z^1$. When the pH of the aqueous solution is low, the oxidizing power becomes high. Accordingly, the pH of a strong oxidation condition is preferably from 0.1 to 3.5, more preferably from 0.5 to 3.0. It is preferred to adjust the oxidation condition with oxyacid. The temperature is preferably high, preferably from 40 to 99° C., more preferably from 50 to 90° C. The higher the equilibrium electrode potential of a half cell reaction of the oxidizing agent in the aqueous solution (which can be obtained by the Nernst's equation), the higher is the oxidizing power putting all conditions together. On the other hand, when these factors are shifted to the opposite directions, the oxidizing power becomes weak.

As a weak oxidizing agent, an oxidizing agent having a standard electrode potential of from 0 to 1.0, preferably from 0.2 to 0.8 can be exemplified.

By way of specific example, when $H_2O_2$ is added to an aqueous solution of a compound of formula $Z^1$ (a solution of from 3 to 20% by weight) in an amount of preferably from 0.1 to 10 times, more preferably from 0.3 to 3 times, of the existing mol number of the —S— group, and the aqueous solution is maintained at moderate conditions (at 20 to 50° C. and pH of from 3.5 to 9) for a long period of time (from 2 to 100 hours), the oxidation of ($Z^1 \rightarrow Z^2$) occurs at the mol ratio $X_7$ of $[Z^2/(Z^2+Z^3)]$ of preferably from 0.7 to 1.0, more preferably from 0.9 to 1.0. In this case, the reaction rate $X_8$ of ($Z^1 \rightarrow Z^2$) (the mol amount of $Z^2$/original mol amount of $Z^1$) is preferably from 0.01 to 1.0, more preferably from 0.3 to 1.0.

On the other hand, when the aqueous solution is maintained at strong oxidation conditions (at 40 to 95° C. and pH of from 0.1 to 3) for a long period of time, the mol ratio $X_9$ of $[Z^2/(Z^2+Z^3)]$ of from 0 to 0.69, preferably from 0 to 0.5 can be obtained. In this case, the reaction rate $X_{10}$ of ($Z^1 \rightarrow Z^3$) (the mol amount of $Z^3$/original mol amount of $Z^1$) is preferably from 0.01 to 1.0, more preferably from 0.3 to 1.0.

In this case, if the oxidizing power is too strong, —OH groups in $B^1$ are also oxidized. It is preferred to suppress the oxidation of $B^1$ in a low degree. That is, the number of —OH groups to be oxidized is from 0 to 50%, preferably from 0 to 20%, and more preferably from 0 to 5%, of all the —OH groups in $B^1$, and which regulation concerning $B^1$ is the same after oxidation. Further, it is preferred to substantially remove the remaining oxidizing agent not reacted after reaction. "Substantially" used herein means from 20 to 100%, preferably from 50 to 100%, and more preferably from 90 to 100%, of the mol amount of the remaining oxidizing agent.

The removing method of the remaining oxidizing agent include the following methods:

(1) A reducing agent is added to cause a reaction with the remaining oxidizing agent thereby the remaining oxidizing agent is nullified (neutralized). It is preferred to select optimally the kind and the addition amount of a reducing agent by trial and error. The amount of a reducing agent is preferably found by oxidation reduction titration or an oxidation reduction indicator. This is a method of finding the addition amount in which a reducing agent is added gradually while measuring oxidation reduction potential of a solution in such a way that the potential falls within a certain range when the reaction reached equilibrium state.

An oxidizing agent is added to a solution rapidly to find out beforehand the relationship between the addition amount and the potential. At this time, it is preferred to read out the potential in the state that from 70 to 100%, preferably from 90 to 100%, of the oxidizing agent added is unreacted and the potential is near equilibrium. For that purpose, the reaction of the oxidizing agent is preferably slow and the temperature is, in general, preferably low (preferably from 1 to 50° C., more preferably from 5 to 40° C.). The concentration of the remaining oxidizing agent can be found from the potential.

Subsequently, the oxidizing agent is added gradually and the equilibrium potential is adjusted so as to fall in the range which satisfies the necessary conditions of the above-described amount of the remaining oxidizing agent. In this case, it is preferred to sufficiently react the reducing agent added with the remaining oxidizing agent and measure the potential after the reaction reached the equilibrium condition. For that purpose, the reaction rate of the reducing agent is preferably increased and the temperature is, in general, preferably high (preferably from 20 to 90° C., more preferably from 40 to 80° C.).

An oxidation reduction indicator means a material which shows the oxidant and the reductant in different colors and rapidly discolors at a certain oxidation reduction potential. A reducing agent is added to a solution of the state where this material has been added to find the addition amount of a reducing agent necessary to adjust the potential satisfying the above-described conditions. In practical use, the reducing agent is added in the obtained addition amount without the indicator and the obtained dispersion medium is preferably used after reaction.

(2) One or more metal catalyst(s) which decompose(s) an oxidizing agent is(are) added to a reaction solution to decompose and inactivate an oxidizing agent. For example, when the oxidizing agent is $H_2O_2$, by the addition of a heavy metal having a specific gravity of 4.0 or more, a metal salt of the heavy metal, or a metal oxide of the heavy metal, a decomposition reaction of $2H_2O_2 \rightarrow H_2O_2+O_2$ is accelerated, thereby $H_2O_2$ can be removed.

As specific examples of them, transition metals belonging to group VIII of the Periodic Table such as Pt and Pd, colloid of Mn metal, a metal oxide such as $MnO_2$, $Co_2O_3$, and $PbO_2$, metal salts of iron and copper can be exemplified. When these metal catalysts are used, pH of the solution can be selected from pH 1 to 12 but the reaction is accelerated when the pH is higher. Accordingly, the pH is selected preferably from 4 to 12, more preferably from 6 to 11.

After the oxidizing agent is decomposed, the metal catalysts are preferably removed from the solution. As removing methods of a metal catalyst, the following methods can be exemplified: 1) a method of stopping stirring, allowing the solution to stand as it is, and sucking the supernatant gently after the catalyst has been deposited, 2) a method of filtering out the catalyst from the solution with a filter, 3) a method of centrifuging the solution to deposit the catalyst, and then sucking the supernatant gently, 4) a method of dispersing the catalyst in a gelatin aqueous solution, adding a hardening agent thereto, and then coating the solution on a support. The coated support is dried to advance the film-hardening reaction, this is added to the solution containing the oxidizing agent to accelerate the reaction, thereby the object is achieved. The hardened film prevents the gelatin film from being dissolved in the solution. The dry film thickness is preferably from 0.1 to 100 $\mu$m, more preferably from 1 to 30 $\mu$m. 5) A method in which the catalyst is added to the solution in the form of a non-powder (e.g., a stick-like form, a fine line-like form, a mesh-like form, a particle having a diameter of 3 $\mu$m or more, preferably from 10 $\mu$m to 1 cm), the reaction is accelerated, and the catalyst is taken out of the solution when becomes unnecessary, and 6) a method of making a column containing the catalyst and passing the solution through the column, thus the object is achieved. The remaining rate of the catalyst $b_3$ (remaining weight/addition weight) is preferably from 0 to 0.4, more preferably from 0 to 0.1, and still more preferably from 0 to 0.01.

(3) Addition of a base. If a base is added, a decomposition reaction of an oxidizing agent is accelerated. As examples of bases, hydroxides of highly positive metals (e.g., alkali metal, hydroxides of alkaline earth metals), amines, and certain kinds of metal complexes (e.g. $Pt(NH_3)_6(OH)_4$) can be exemplified. When the reaction is terminated, acid is added to neutralize the base ($H_3O^+ + OH^- \rightarrow 2H_2O$). The base added is regarded to be removed by this procedure. The neutralization amount can be known by reading the increase of the pH value due to the addition of the base and the decrease of the pH value due to the addition of the acid.

After the remaining oxidizing agent has been removed thus, the obtained compound can be added, as it is, or after being dehydrated, or after further being dried, to the reaction vessel for forming AgX grains. Alternatively, the compound can be added after being desalted. Examples of desalting methods include an ion exchange resin method, an electrodialysis method, an ultrafiltrating washing method, and a method of cooling, gelling and washing.

(4) Addition of peroxidase.

When the remaining oxidizing agent is $H_2O_2$ or an organic peroxy compound, the oxidizing agent can be decomposed by adding peroxidase. Peroxidase is, in general, a generic name of enzymes which catalyze the reaction of ($H_2O_2+AH_2 \rightarrow 2H_2O+A$) and is broadly distributed in the animal, vegetable, and microorganism kingdoms. Catalase is $AH_2=H_2O_2$ and, in addition, examples of $AH_2$ corresponding to phenols, aromatic amines, cytochrome C, Hl, and glutathione can be exemplified. When $AH_2$ is added, the decomposition of $H_2O_2$ is accelerated. Once the peroxidase is added to the solution, it can be removed with difficulty. In view of this point, the above-described methods (1) to (3) are more preferably used.

As the sulfinyl group gives infrared absorption of S—O expansion at from 1,040 to 1,060 $cm^{-1}$, the yield of a compound of formula $Z^2$ can be estimated by making use of this. As the sulfonyl group gives infrared absorption at from 1,130 to 1,160 $cm^{-1}$ and from 1,310 to 1,350 $cm^{-1}$, the yield of a compound of formula $Z^3$ can be estimated by making use of this. A thioether group gives infrared absorption at from 600 to 800 $cm^{-1}$. With respect to ultraviolet absorption, as a thioether gorup gives ultraviolet absorption at from 194 nm, a sulfinyl group at 210 nm, and a sulfonyl group at 180 nm, the degree of the progress of oxidation reaction can be confirmed in some cases from the change of ultra-violet absorption spectra. If mass spectrum measurement of these molecules is feasible, the progress degree of the oxidation reaction can be checked by measuring mass spectrum and comparing each spectrum strength.

In addition, the degree of the progress of the oxidation reaction can be confirmed with making use of silver potential titration. As a thioether group are bonded to $Ag^+$ but a sulfinyl group, a sulfonyl group and a sulfonium group are not bonded to $Ag^+$, there occurs a change on the graph of the aqueous solution (silver potential vs the addition amount of $AgNO_3$). The degree of the progress of the oxidation reaction can be confirmed from the amount of that change. The calibration curve of the relationship between the change amount of the silver potential curve and the progress of the reaction is obtained beforehand using a simple low molecular weight compound such as $HO—(CH_2)_2—S—(CH_2)_2—OH$, and the progress of the reaction can be confirmed by comparing with the calibration curve. Further, it can also be confirmed by measuring the silver potential of the solution without adding $AgNO_3$. This is attributable to the fact that the silver potential decreases with the increase of the existing concentration of the thioether group. This is thought to be due to the adsorption of the thioether group onto the silver electrode. A sulfinyl group, a sulfonyl group and a sulfonium group hardly reduce a silver potential.

The progress of the reaction can also be confirmed by X-ray photoelectronic spectroscopic measurement of the sulfur groups of the surfaces of the solid samples of compounds of formulae $Z^1$ to $Z^4$. This is because the chemical shift amount of the sulfur atom changes corresponding to chemical bonding of the sulfur atom.

In addition, the existing amount ratio of compounds of formulae $Z^1$ to $Z^4$ can be found by separating a mixed compound by liquid chromatography or electrophoresis and from the separated positions and the molar ratio of the separated amounts obtained. As PVA develops a color by iodine, the separated position on the development plate can be confirmed using the color-developed PVA. Further, the existing amount ratio can be obtained from the ratio of coloring amounts.

As for details of these analyses, *Bunsekikagaku Binran* (*Analytical Chemistry Bulletin*), Maruzen Co., Ltd. (1991), *Bunsekikagaku Handbook* (*Analytical Chemistry Handbook*), Asakura Shoten Co., Ltd. (1992), *Kiki Bunseki Guidebook* (*Instrumental Analysis Guidebook*), Maruzen Co., Ltd. (1996) can be referred to.

Oxidizing Agent, Reducing Agent, Acid, Base

Oxidizing agents, reducing agents, acids, bases which can be used in the present inention are as follows.

Oxidizing Agent

Specific examples of oxidizing agents include $O_2$, $O_3$, compounds easily releasing oxygen (e.g., $H_2O_2$, organic thiosulfonic compounds, AgO, $Ag_2O$), and peroxides [compounds having an oxygen bridge (—O—O—) in the molecule, therefore, all peroxides can be regarded as derivatives of hydrogen peroxide H—O—O—H. Peroxides are classified to an inorganic peroxide (metal peroxides and nonmetal peroxides) and an organic peroxide by the kind of the substituent which substitutes H. The higher the positivity, the more stable is the metallic peroxide. For example, as to alkaline earth metals (Ba>Sr>Ca>Mg), there can be exemplified $Na_2O_2$, $BaO_2$, $MgO_2$, and $CaO_2$ as examples of metal peroxides, $KNO_4$ and $K_2CO_4$ as examples of nonmetal peroxides, and peroxy formic acid, peroxy acetic acid, peroxy benzoic acid, and peroxy phthalic acid as examples of organic peroxides. Oxidizing power is attributable to the oxygen of an oxygen bridge. Peroxides generate $H_2O_2$ in an acidic aqueous solution, in general. The salt of a peroxy acid is also a peroxide. Peroxy acids are acids having the oxygen bridge, and almost all peroxy acids corresponding to generally-known oxyacids are known, e.g., $H_2SO_5$, $H_3PO_5$, and $HNO_4$. As specific examples of other peroxide compounds, *Kaqaku Dai-Jiten* (*Encyclopaedia Chimica*), Kyoritsu Shuppan Co., Ltd. (1964), description of items from peroxy to bergaptin can be referred to.]

Another examples of oxidizing agents include a compound having a high oxidation number [a compound in which a center atom has two or more oxidation numbers, and "a compound having a high oxidation number" herein means a compound in which the oxidation number is not the lowest value of these oxidation numbers. The higher the oxidation number, the higher is the oxidation power of the compound. Specific examples of compounds having a high oxidation number include $NiO_2$, $N_2O_{41}$ lead peroxide ($PbO_2$), nitrogen peroxide, perchloric acid ($HClO_4$), permanganic acid ($HMnO_4$), periodic acid ($H_5IO_6$), a high oxidation number sulfur compound (chloramine, an organic thiosulfonic acid compound), $FeCl_3$, $CuCl_2$, $MnO_2$, $KMnO_4$, and $Na_2CrO_4$.], halogen ($Cl_2$, $Br_2$l $I_2$), and organic nitro compounds. These compounds may be used alone or in combination of two or more. Of these, peroxides and compounds having high oxidation number are preferred and $H_2O_2$ is more preferred.

Reducing Agent

Specific examples of reducing agents include $H_2$, comparatively labile hydrogen compounds (e.g., sodium borohydride, lithium aluminum hydride), salts of lower oxides or lower oxyacids (e.g., CO, $SO_2$, sulfite), metals having high electric positivity (e.g., alkali metals, Mg, Ca, Al, Zn or amalgam of them), salts of metals in the state of low valence (e.g., Fe(II), Sn(II), Ti(III), Cr(II)), organic compounds of low oxidation degree (e.g., aldehydes, saccharides, formic acid, oxalic acid), and well-known reduction sensitizers for AgX emulsions (e.g., thiourea dioxide, polyamine, amineborane). Of these reducing agents, reducing agents the reduction reaction products of which do not give adverse influences to photographic properties are preferred, e.g., salts of lower oxides or lower oxyacids and reduction sensitizers are preferred, and sulfite and $SO_2$ are more preferred.

Compounds having a standard electrode potential lower than that of the oxidizing agent used by 0.2 to 3 V, preferably by 0.5 to 2 V, are preferably used.

"A standard electrode potential" used herein means the electrode potential in a standard state of a half cell of the objective material taking a standard hydrogen electrode potential as 0.0 V.

As oxidizing agents, reducing agents, oxidation, reduction, standard electrode potential, oxidation reduction titration, and separation and purification, the following literature and patents can be referred to: *Research Disclosure*, 1996, JP-A-8-69069, Chemistry Association, Japan, compiled, *Kagaku Binran Kiso-Hen* (*Chemical Handbook, Elementary Course*), Chapters 10 to 12, *Kagaku Binran Oyo-Hen* (*Application Course*), Maruzen Co., Ltd. (1984), Chemistry Association, Japan, compiled, *Shin Jikken Kagaku Koza* (*New Experimental Chemistry Course*), Vol. 15, "Oxidation and Reduction", Maruzen Co., Ltd. (1976), Minoru Imoto compiled, *Koza Yuki Hanno Kiko* (*Course of Organic Reaction Mechanism*, Vol. 10, Tokyo Kagaku Dojin (1965), Yoshiro Ogata compiled, *Yuki Kagobutsu no Sanka to Kangen* (*Oxidation and Reduction of Organic Compounds*), Nankodo Co., Ltd. (1963), JP-A-61-3134, *Sekai Kagaku Daijiten* (*World's Chemical Encyclopedia*), items of "Oxidation Reduction", "Oxidation Process", and "Oxidizing Agent", Kodansha Co., Ltd. (1977), Britannica, *International Encyclopedia*, "Oxidation and Reduction", TBS Britannica (1988), Iwanami Koza, *Gendai Kagaku* 9 (*Modern Chemistry* 9), "Acid-Base and Oxidation Reduction", Iwanami Shoten Co., Ltd. (1980), G. D. Christian, *Analytical Chemistry*, 4th Ed., John Wiley & Sons (1986), *Kagaku Dai-Jiten*, Vol. 3, pp. 902 to 905, Kyoritsu Shuppan Co., Ltd. (1963), *Denki-Kagaku Binran* (*Electrochemistry Handbook*), Maruzen Co., Ltd. (1985), and *Bunseki Kagaku Handbook* (*Analytical Chemistry Handbook*), Asakura Shoten Co., Ltd. (1992).

As acid and alkali (base) which can be used in the present invention, the description in *Kagaku Binran Kiso-Hen*, Chapter 10, Maruzen Co., Ltd. (1984) can be referred to, and $HNO_3$, $H_3PO_4$, $H_2SO_4$, NaOH, KOH, $Na_2CO_3$ can be preferably used.

(A3) Explanation of Compound Represented by Formulae ($Z^4$)

Compound of formula $Z^4$ is a compound obtained by making a thioether group of compound of formula $Z^1$ a sulfonium salt and represented by formula (11), which is generally obtained by alkylating the thioether group using an alkylating agent. As alkylating agents, alkyl halide, alkyl sulfonate, sulfate, trialkyl oxonium salt, fluoromethanesulfonate are preferably used. Among alkyl halides, alkyl iodide is preferably used due to its high reactivity. The reactivity largely changes by the structures of alkyl groups. For preventing side reactions during the reaction, use of catalysts or addition of $AgClO_4$ or $AgBF_4$ to accelerate the reaction is preferred. As one example of such a catalyst, $HgI_2$ which accelerates the reaction of alkyl iodide can be exemplified.

Sulfonium halide salt ($Z^{41}$) can be obtained by adding alkyl halide to an aqueous solution of a compound of formula $z^1$, and sulfonium hydroxide salt (a sulfonium salt group) ($Z^{42}$) can be obtained by reacting $Z^{41}$ with silver oxide (I).

Further, anion seeds can be exchanged by treatment with anion exchange resins. For example, if sulfonium iodide salt is treated with a $Cl^-$ type anion exchange resin, it is converted to sulfonium chloride salt. When sulfonium iodide salt is treated with a nitrate type anion exchange resin, it is converted to sulfonium nitrate. These can be selectively used according to purposes.

Sulfonium salt can also be obtained by reacting a thioether group with olef in and a strong acid (e.g., $H_2SO_4$), or by reacting a highly reactive alcohol (e.g., p-nitrobenzyl alcohol) with $HClO_4$.

Sulfonium salt can also be obtained in a manner such that a sulfinyl group is o-alkylated to obtain alkoxysulfonium salt, and then this alkoxysulfonium salt is reacted with organic cadmium or reacted with Grignard reagent, further sulfonium salt can be obtained by directly reacting a sulfinyl group with Grignard reagent. However, rapid treatment is necessary because alkoxysulfonium salt is liable to react with water and return to the former sulfinyl group.

As a sulfonium salt type compound, an oxosulfonium salt type compound represented by formula (12) can also be preferably used. This compound can be obtained, for example, by reacting a sulfinyl group with methyl iodide, or by oxidizing a sulfonium salt with a peracid anion.

In addition, s-aminooxosulfonium salt can be exemplified as an oxonium salt. This can be obtained, for example, by reacting a sulfinyl group with o-mesitylenesulfonylhydroxylamine.

Specific examples of alkylating agents include $CH_3I$, $ICH_2CONH_2$, $ICH_2COOH$, iodoacetate, bromoacetate, ethyl bromide, butyl chloride, methyl sulfonate, and $CH_3SO_3H$. With respect to details of the synthesis methods of compounds of formulae $Z^1$ to $Z^4$, JP-A-2-301742, *Shin Jikken Kaqaku Koza* 14 (*New Experimental Chemistry* 14), "Synthesis and Reaction of Organic Compounds III", Chap. 8, Maruzen Co., Ltd. (1978) can be referred to.

$Y_0^-$ represents an anion group, specifically, $OH^-$, a halogen ion ($Cl^-$, $Br^-$, $I^-$), an acid radical ($NO_3^-$, $SO_4^{2-}/2$), $BF_4^-$, $ClO_4^-$, and $SbCl_6^-$ can be exemplified. As anion groups, *Chemical Dictionary*, Supplement 5, Tokyo Kagaku Dojin (1994), *The Dictionary of Physics and Chemistry*, 3rd Ed., Supplement XIV, Iwanami Shoten Co., Ltd. (1971) can be referred to.

The reaction rate of ($Z^1 \rightarrow Z^4$) (the mol amount of $Z^4$/original mol amount of $Z^1$) is preferably from 0.01 to 1.0, more preferably from 0.3 to 1.0.

(I-4) Preparing Method of Tabular Emulsion Grains (1)

(A1) Formation of Seed Crystals of Tabular Grains

For forming tabular grains, seed crystals of tabular grains are formed in the first place, then the projected area ratio of these seed crystals are increased according to necessity and tabular grains are further grown to a desired size. For forming these seed crystals, it is necessary to add $Ag^+$ and $X^-$ to a solution of a dispersion medium containing compound $A^0$ to form AgX grains having the above-described crystal defects. In the first place, the seed crystal forming process is described. The addition method of $Ag^+$ and $X^-$ to a solution of a dispersion medium containing compound $A^0$ is described below.

(1) $Ag^+$ and $X^-$ are added to a solution of a dispersion medium containing compound $A^0$. In this case, it is presumed that compound $A^0$ is adsorbed onto AgX ultra-fine grains just formed by the addition of $Ag^+$ and $X^-$, then $Ag^+$ and $X^-$ are deposited on the ultra-fine grains, thus the defects are formed, and grains which grow anisotropically appear.

(2) In a dispersion medium solution not containing compound $A^0$, compound $A^0$ is added to the dispersion medium solution after starting of the addition of $Ag^+$ and $X^-$. Compound $A^0$ can be added while adding $Ag^+$ and $X^-$ or compound $A^0$ can be added after stopping the addition of $Ag^+$ and $X^-$. In this case, compound $A^0$ is adsorbed onto AgX fine grains ($a_3$) formed by the addition of $Ag^+$ and $X^-$, and $Ag^+$ and $X^-$ subsequently added are deposited on the above fine grains to form the defects and grains which grow anisotropically appear.

In this case, comparative experiments were conducted by forming various fine grains as models not changing the kinds of compound $A^0$ subsequently added and the addition conditions of $Ag^+$ and $X^-$ subsequently added. The following results were obtained.

(a1) The smaller the grain size of fine grains, the more was the probability of formation of tabular grains having main planes of nearly square. The diameter of the fine grain is preferably 0.30 $\mu$m or less, more preferably from 0.003 to 0.2 $\mu$m, and still more preferably from 0.003 to 0.10 $\mu$m.

(a2) The fine grains are preferably non-twin crystal grains substantially not having twin planes. Non-twin crystal grains herein means the number ratio of grains containing one or more twin planes is from 0 to 5%, preferably from 0 to 1%, more preferably from 0 to 0.1%, and still more preferably from 0 to 0.01%, because a twin crystal grain is difficult to become a tabular grain and vanishes by Ostwald ripening with difficulty.

Further, these fine grains are preferably non-defective grains which substantially do not have the defects. Non-defective grains herein means the number ratio of grains having the defects is 10% or less, preferably from 0 to 1%.

The fine grains are formed in a mixer installed outside the emulsion accumulator by a batch system, compound $A^0$ is then added thereto and the emulsion is transferred to the accumulator, and this procedure can be repeated from 1 to $10^4$ times, or alternatively it is also possible that, while continuously feeding a dispersion medium solution to the accumulator through the mixer, an $Ag^+$ solution and an $X^-$ solution are added to the mixer to successively form fine grains, and compound $A^0$ is added and adsorbed onto the fine grains before the grains enter the accumulator.

The fine grains are generally prepared by adding $Ag^+$ and $X^-$ simultaneously to a dispersion medium solution and mixing with thoroughly stirring. As details of the preparation method of fine grains, JP-A-2-146033, JP-A-1-183417 and the literature described later can be referred to.

(a3) As crystal habit of the fine grain, [total area of {100} faces/total surface area-of the grain] is 0 to 1.0, preferably from 0.3 to 1.0, and more preferably from 0.6 to 0.9.

(a4) The concentration of $X^-$ in the solution when compound $A^0$ is added is preferably from $10^{-1}$ to $10^{-5}$ mol/liter, more preferably from $10^{-1.8}$ to $10^{-4.0}$ mol/liter.

(a5) The pH of the solution when compound $A^0$ is added is preferably from 1 to 12, more preferably from 2 to 10.

(a6) The temperature of the solution when compound $A^0$ is added is preferably from 5 to 99° C., more preferably from 10 to 80° C., and still more preferably from 10 to 50° C.

(a7) When compound $A^0$ is added and adsorbed onto AgX grains after an adsorbent $B^0$ which is adsorbed onto AgX grains has been adsorbed onto AgX grains, the forming probability of tabular grains and tabular shapes change according to the kind and addition amount of adsorbent $B^0$ and the combination of conditions such as the pH of the solution, the concentration of $X^-$ and the temperature. Specifically, adsorbent $B^0$ can be selected from an AgX solvent, an antifoggant, a spectral sensitizing dye, a surfactant, and a dispersion medium and can be added in a desired amount. With respect to adsorbent $B^0$, the literature described later can be referred to. A compound, in particular, which accelerates the formation of {100} faces is preferred, e.g., a compound having one or more groups, preferably from 1 to 100 groups, of one or more kinds of a —COOH, imidazole, benzoxazole, benzimidazole group in one molecule is preferred. The addition amount of adsorbent Bo is preferably from $10^{-7}$ to 1.0 mol/liter, more preferably from $10^{-6}$ to $10^{-1}$ mol/liter.

With the change of conditions (a1) to (a7), the state of adsorption of compound $A^0$ changes, and the forming probability of tabular grains and tabular shapes change according to the adsorption state of compound $A^0$. Accordingly, the most preferred combination of conditions can be selected.

After compound $A^0$ has been added, $Ag^+$ and $X^-$ can further be added under the same solution condition of the solution or, alternatively, $Ag^+$ and $X^-$ can further be added after the condition of the solution has been changed. The condition of the solution means the concentration of $X^-$, pH, temperature, the concentration of a dispersion medium, the kind of a dispersion medium, and the addition of adsorbent $B^0$. The concentration of $X^-$, pH, and the concentration of adsorbent $B^0$ can be selected from the same ranges as above. The temperature is preferably from 5 to 99° C., more preferably from 10 to 90° C., and still more preferably from 40 to 85° C. In this case, the addition rate of $Ag^+$ and $X^-$ largely affects the formation frequency of the tabular grains. That is, when the addition rate is increased, the formation frequency is increased and a small size tabular grain emulsion can be obtained. In contrast to this, if the addition rate is lowered, the formation frequency is reduced. The most preferred condition of the addition rate can be selected.

(3) A method of increasing the addition amount of compound $A^0$ with the increase of the addition amounts of $Ag^+$ and $X^-$:

Compound $A^0$ can be added continuously or intermittently. Compound $A^0$ can be added while adding $Ag^+$ and $X^-$, can be added while stopping the addition of $Ag^+$ and $X^-$or both modes can be used in combination. Preferred methods of the present invention include a method of adding compound $A^0$ in the state of being incorporated in an $Ag^+$ solution and/or an $X^-$ solution to be added; a method in which when the total addition amount of $Ag^+$ is increased to $a_4$ times during grain formation, the total addition amount of compound $A^0$ is increased to $a_5$ times, wherein $a_5/a_4$ is preferrably from $10^3$ to $10^{-3}$, more preferably from $10^2$ to $10^{-2}$, and still more preferably from 10 to 0.1; and a method in which the total addition amount of compound $A^0$ is preferably increased to 1.1 times or more, more preferably from 2.0 to $10^4$ times, and still more preferably from 5 to $10^2$ times, of the initial addition amount during the time from the initial stage of grain formation to the final stage.

(4) A method of generating the defects by Ostwald ripening with AgX grains and compound $A^0$ being put in a reaction vessel:

A mode of using only one kind of AgX fine grains, two or more, preferably mixtures of from two to six kinds of fine grains can be exemplified. The grain size of the fine grains is preferably 0.30 μm or less, more preferably from 0.01 to 0.20 μm. Two or more kinds of grains include grains having different grain diameters, grains having different halogen compositions, grains having different structures of halogen compositions inside the grains, and grains having different shapes or surface crystal habits. The grains having different grain diameters means the grains whose average grain diameters are different by 0.01 to 0.4 μm, preferably by 0.03 to 0.3 μm, and grains having different halogen compositions means the grains in which either the AgCl content or AgBr content in the grain differs preferably by 1.0 to 100 mol %, more preferably by 5 to 80 mol %, from each other. As grain shapes and surface crystal habits, *Research Disclosure*, No. 389, Item 38957 (September, 1996) (herein-after referred to as "RD, 1996") and the literature described later can be referred to.

The existing amount of compound $A^0$ present in the dispersion medium solution (the weight of compound $A^0$/the weight of the dispersion medium), $x_1$ is preferably from $10^{-3}$ to 100, more preferably from $10^{-2.5}$ to 10, and still more preferably from $10^{-2}$ to 1.0. The seed crystal formation is largely affected by the adsorption strength of the dispersion medium used onto AgX grains. When the concentration (mol/liter) of dispersion media are the same, the weaker the adsorption strength, the more the addition amount of compound $A^0$ required to form the seed crystals tends to lower. For example, taking gelatin as an example, the more the oxidation rate of the thioether group of the methionine group in gelatin by oxidation process, or the more the chemical modification rate of the amino group (e.g., phthalation rate, succination rate, trimellitation rate), or the more the chemical modification rate of the imidazole group or arginine group, or the lower the molecular weight, the lower is the adsorption strength. This is because these groups functioning as adsorbing groups onto the AgX grains are incapacitated. Further, even if the modification rates are the same, the higher the water solubility of the group modified, the lower is the adsorption strength, this is because if the water solubility of the molecule of the group adsorbed is high, the group is liable to be desorbed to an aqueous solution phase. The modification rate of one or more of a methionine group, an amino group, an imidazole group or an arginine group may be from 0.1 to 100%, preferably from 1.0 to 90%, and more preferably from 10 to 70%.

On the other hand, when an ionic group is chemically modified to a nonionic group (e.g., —COOH→—$CONH_2$), or a group having high hydrophobicity is introduced to get the system hydrophobic (e.g., benzoylation of an amino group), adsorption strength becomes higher. This is presumed that adsorption equilibrium deviates as the adsorptive molecule is difficult to get into the aqueous solution phase. In this case, there is a tendency of requiring a larger amount of compound $A^0$ for forming tabular seed crystals but there is also an advantage of being able to obtain smaller size tabular seed crystals. Accordingly, the modification rate of introducing a hydrophobic group is from 0.1 to 100%, preferably from 1.0 to 80%.

With respect to details of these characteristics and chemically modified gelatin, item (I-8) described later can be referred to.

On the other hand, the lower the dispersion medium concentration, the more reduced is the addition amount of compound $A^0$ required to form seed crystals. The less the addition amount of compound $A^0$, the less is the side reaction by compound $A^0$, which is preferred and, vice versa, which is followed by the advantage of being capable of obtaining small size tabular grains. Therefore, the most preferred dispersion medium concentration can be used according to purposes. The dispersion medium concentration is preferably from 0.01 to 15 wt %, more preferably from 0.1 to 10 wt %.

It can be interpreted that the method (1) is a mode of the method (2) in which $a_3$ is made small to the utmost limit. The temperature in methods (1) to (4) is preferably from 1 to 99° C., more preferably from 10 to 90° C., and preferred temperature can be used selectively. In method (4), it is necessary to select temperature at which Ostwald ripening can occur. The pH in methods (1) to (4) is preferably from 1 to 12, more preferably from 1.7 to 11, the concentration of $X^-$ is preferably from $10^{-1}$ to $10^{-5}$ mol/liter, more preferably from $10^{-1.8}$ to $10^{-4}$ mol/liter, and preferred combination can be selected. When $a_3$ in the above method (2) is formed, the diameter of $a_3$ is preferably smaller. For forming small $a_3$, a low temperature is preferred, such as from 0 to 50° C., preferably from 5 to 40° C. An adsorbent $B^0$ can also be used in methods (1), (3) and (4) in the same addition amount.

In these cases, the addition amount of compound $A^0$ is from 0.01 to 150 g/liter, preferably from 0.1 to 50 g/liter. Thus, tabular seed crystals are formed. The number ratio of tabular seed crystal in all the grains present at this stage is preferably from $10^{-4}$ to 100%, more preferably from $10^{-3}$ to 100%, and still more preferably from $10^{-2}$ to 100%.

(A2) Ripening Process

If the number ratio of tabular seed crystal is low, Ostwald ripening is conducted subsequently to vanish non-tabular grains and grow tabular grains, thereby the number ratio of tabular grains can be increased to 1.2 times or more, preferably from 2 to $10^3$ times or more. Further, it is preferred to increase the number ratio by 1% or more, preferably by 10% or more. In this case, it is preferred to carry out the ripening at temperature higher than the temperature of the seed crystal forming process by 5° C. or more, preferably by 10 to 70° C.

If the objective tabular grain emulsion can be obtained only in the tabular seed crystal forming process, the formation of tabular grains can be terminated at that stage, or if the objective tabular grain emulsion can be obtained at the terminal stage of the ripening process, the formation of tabular grains can be terminated at that stage. In many cases, tabular grain emulsions are prepared through the process of (tabular seed crystal forming→ripening→growing), but ripening process can be omitted.

(A3) Growing Process

Growing process means the process of adding $Ag^+$ and $X^-$ and growing tabular seed crystals. The following methods can be exemplified as a growing mode.

(1) When the ratio of non-tabular fine grains is high, tabular grains are grown by the addition of $Ag^+$ and $X^-$ at low feeding rate followed by vanishing of the non-tabular fine grains by Ostwald ripening. Accordingly, the projected area ratio of the tabular grains is increased with the growth of the tabular grains.

(2) A previously prepared AgX fine grain emulsion is added intermittently one time or more, preferably 2 times or more, or continuously, or by combination of these. The fine grains are vanished by ripening and tabular grains are grown.

(3) Splash addition (a method of adding $Ag^+$ and $X^-$ rapidly within a short period of time to generate new AgX fine grains in a reaction solution) is carried out one time or more, preferably two times or more, intermittently. The newly formed fine grains are dissolved by ripening and tabular grains are grown.

Fine grains described in (2) and (3) are preferably non-twin fine grains, more preferably non-defective fine grains.

(4) A method of adding $Ag^+$ and $X^-$ at addition rate of from 1 to 100%, preferably from 10 to 90%, of critical addition rate. Critical addition rate used here means the addition rate which generates new nuclei if $Ag^+$ and $X^-$ are added faster than that rate. The higher the supersaturation degree, the narrower is the size distribution of tabular grains, but the thickness is also increased. If thin tabular grains are desired, the addition rate is 60% or less, preferably from 1 to 40%, of the critical addition rate.

(A4) Prevention of Formation of New Tabular Seed Crystals

New tabular seed crystals are preferably prevented from being generated in the ripening and growing processes. The following methods are preferably used for that purpose.

(1 Selection of the solution condition to reduce the adsorption strength of compound $A^0$: The adsorption strength of compound $A^0$ lowers as the pH lowers. Accordingly, pH in the ripening and growing processes is made lower than that in the seed crystal forming process by 0.1 or more, preferably by 0.3 to 5.0. For reducing the pH, it is sufficient to introduce an acid. In a converse case, an alkali may be used. In general, if the concentration of $X^-$ is increased, the adsorption strength of compound $A^0$ is reduced. Accordingly, the concentration of $X^-$ is made higher than the concentration of $X^-$ in the seed crystal forming process by 1.1 times or more, preferably by 1.6 to 1,000 times, and more preferably by 2 to 100 times. When the temperature is increased, the adsorption strength of compound $A^0$ is reduced. Accordingly, the temperature is made higher than that in the seed crystal forming process by 3 to 80° C., preferably by 6 to 70° C.

(2) Modification of compound $A^0$ to reduce the adsorption strength of compound $A^0$: For example, an oxidizing agent is added to oxidize compound $A^0$ to reduce the adsorption strength, for example, oxidizing a thioether group to a sulfoxide group (a sulfinyl group) or a sulfonyl group, oxidizing an alcohol group to an aldehyde group or carboxylic acid can be exemplified. In addition, esterification of an alcohol group, in particular, sulfonic acid esterification is more preferred. A method of adding a compound which can form a molecular compound with PVA such as boric acid or borax in an amount of from 0.01 to 100 g/liter can also be used. The modification rate by these compounds is preferably from 1 to 100%, more preferably from 10 to 90%.

(3) Removal of from 1 to 100% of compound $A^0$ from an AgX emulsion: After setting up the pH of the AgX emulsion, the concentration of $X^-$, and the reaction temperature as in the above item (1), or after modification of compound $A^0$ as in the item (2), or after both treatments are conducted in combination, desalting treatment is carried out, and then compound $A^0$ or modified compound $A^0$ is removed from the system. Concerning the desalting treatment, the later description can be referred to. In particular, a method of repeating one time or more, preferably from two to ten times, the following procedure is preferred, i.e., centrifuging the emulsion, removing the supernatant, dispersing the emulsion again by adding water or a dispersion medium solution. Concerning the kind of the dispersion medium and the concentration of the dispersion medium solution, the later description can be referred to.

As compound $A^0$ also has a function as an accelerator for forming {100} faces, if it is removed from the system, the $X^-$ concentration condition suitable for forming tabular grains is shifted to low concentration side. In such a case, it is possible to form tabular grains by shifting the $X^-$ concentration condition, but it is more preferred to add new {100} face-forming accelerator $B^0$. It becomes possible to form tabular grains in wider $X^-$ concentration range by adding accelerator $B^0$. The addition amount of accelerator $B^0$ means the amount which gives such relationship as the relationship of [silver potential of the solution (to saturated calomel electrode) with the shape of AgBr grains] is shifted to lower potential side by 10 mV or more, preferably by 20 to 150 mV, and more preferably by 30 to 100 mV, compared with the relationship in the system where deionized alkali-processed ossein gelatin is used as a dispersion medium. This relationship is disclosed in JP-A-8-339044 in detail. The addition amount of accelerator $B^0$ is generally from $10^{-7}$ to $10^{-1}$ mol/mol of AgX, preferably from $10^{-6}$ to $10^{-2}$ mol/mol of AgX.

(4) Increment of the concentration of compound $A^0$: If the addition amount of compound $A^0$ is gradually increased, the concentration range where the formation of tabular seed crystals are inhibited in process (A1) is present. This is presumed that this is related with the fact that a large amount of compound $A^0$ is adsorbed onto the grain surface, which retards the growth of grains, and the defects are difficult to be introduced under a slow growing condition. Accordingly, new defects can be prevented from being formed by increasing the concentration of compound $A^0$ higher than that in the seed crystal forming process by 1.1 times or more, preferably by 1.5 to $10^3$ times, and more preferably by 2 to 100 times.

(5) Reduction of addition rate of $Ag^+$ and $X^-$: The lower the addition rate of $Ag^+$ and $X^-$, the lower is the probability of appearing of new isotropically growing grains. Accordingly, $Ag^+$ and $X^-$ are added at addition rate of substantially preventing the formation of new defects. This means that the new defect formation can be inhibited when seed crystals are grown rather under low supersaturation degree. From this point of view, addition methods of (2) and (3) in (A3), in particular, method (2) is preferably used. There is also an advantage that the anisotropic growing degree of tabular grains [(increment of the diameter of a tabular grain/increment of thickness)=$x_5$] is higher when seed crystals are grown rather under low supersaturation degree and tabular grains having high aspect ratio can be obtained.

(6) The probability of new defect formation on the AgX grain by the addition of $Ag^+$ and $X^-$ in the presence of compound $A^0$ decreases as the grain size of the AgX grain increases. In particular, as the probability becomes small in the system where unstable fine grains vanishes through process (A2), it is preferred to incorporate process (A2). Moreover, as seed crystals largely grow with the grain growth, new defect formation is inhibited automatically in this point, too.

(I-5) Preparing Method of Tabular Emulsion Grains (2)

A method of using compound $A^0$ as a {100} face-forming accelerator in partial or all processes of forming tabular grains in another method for preparing tabular seed crystal grains: Compound $A^0$ can be added to the system one time or more at any point of time of one or more during the time from before nucleation to 3 minutes before, preferably 10 minutes before, termination of grain formation. The addition amount of compound $A^0$ is from 0.01 to 150 g/liter, preferably from 0.1 to 50 g/liter, which corresponds to $10^{-3}$ to 10, preferably $10^{-2}$ to 1.0, when prescribed by $x_1$ value. The process of tabular emulsion grains is described in order from the tabular seed crystal formation.

(A1) Tabular Seed Crystal Formation (1 The defects are formed by forming halogen composition gap plane in the AgX seed crystal to form crystal lattice distortion. For example, $Ag^+$ and $Xa^-$ are added to form AgXa in the first place, and then $Ag^+$ and $Xb^-$ are added to form (AgXa|AgXb). In this case, $Xa^-$ and $Xb^-$ are different in the $Cl^-$ content, or $Br^-$ content, or $I^-$ content, by 10 to 100 mol %, preferably by 30 to 100 mol %, and more preferably by 50 to 100 mol %. Here, $Xa^-$ and $Xb^-$ mean the halogen compositions of halide solutions added. One or more, preferably from 1 to 5, more preferably from 2 to 4, gap planes are formed in the seed crystal. As another method of forming (AgXa|AgXb), a method of forming an AgXa nucleus, then adding $Xc^-$ alone, or adding $Xc^-$ and $Ag^+$ in molar amount of $Xc^->Ag^+$, preferably $Xc^->2Ag^+$, and more preferably $Xc^->5Ag^+$, can be exemplified, and this method is more preferred. Here $Xc^->2Ag^+$ means the addition molar amount of $Xc^-$ is 2 times or more of the addition mol amount of $2Ag^+$. Further, the solubility of AgXc is preferably 1/1.5 or less, more preferably ⅓ or less, and still more preferably ⅛ or less, of the solubility of AgXa. In this case, a halogen conversion reaction occurs between Xc and AgXa added and (AgXa|AgXc) is formed. As the addition method of the $X^-$, a method of adding one or more of $Cl_2$, $Br_2$ and $I_2$, then adding a reducing agent to generate $X^-$ can be used. They can be added in any form, e.g., gas, a solution, a solid, or a clathrate compound. Further, they can be added in the mode of $X_2+X^- \rightarrow (X_3)^-$. For example, an aqueous solution of $(I_3)^-$ can be exemplified. As the reducing agent, it is enough to add a reducing agent giving minus standard electrode potential more than a standard electrode potential of $X_2$+2 electrons $\Leftrightarrow 2X^-$. A photographically inactive reducing agent is preferred, e.g., $H_2SO_3$.

In addition, a method of adding a releasing agent of $Br^-$ or $I^-$ to the reaction solution, then releasing $Br^-$ or $I^-$ can be used. With respect to this method, JP-A-6-19029, EP-A-0561415 and U.S. Pat. No. 5,061,615 can be referred to. Besides the above, a method in which an AgXa nuclei are formed in the first place, then AgXb fine grains are added and ripened to form (AgXa|AgXb) halogen composition gap can be exemplified. Here, Xa and Xb are prescribed the same as above. Further, AgXb fine grains means fine grains having a grain size of 0.15 μm or less, preferably from 0.003 to 0.07 μm, and more preferably from 0.005 to 0.05 μm.

(2) A method of previously adding $I^-$ to the dispersion medium solution before nucleation, and/or a method in which, of the $Ag^+$ and $X^-$ which are added at nucleation, $X^-$ is added as a solution containing $I^-$ and $Cl^-$ can be exemplified. In the former case, the addition amount of $I^-$ is from $10^{-5}$ to $10^{-1}$ mol/liter, preferably $10^{-4}$ to $10^{-2}$ mol/liter. In the latter case, the content of $I^-$ is preferably 30 mol % or less, more preferably from 0.1 to 10 mol %. The content of $Cl^-$ is preferably 30 mol % or more, more preferably 50 mol % or more. It is preferred that the defect-forming amount in these cases be decided optimally according to the shapes of the finally formed AgX grains. If the defect-forming amount is too small, the number ratio of tabular grains in the AgX grains becomes small, while when it is too large, many defects are got in one grain and the number ratio of the grains having a low aspect ratio is increased. Accordingly, it is preferred to select the defect-forming amount so as to reach a desired projected area ratio of tabular grains. Further, a method in which $Br^-$ is present in the dispersion medium solution in an amount of from $10^{-5}$ to $10^{-1}$ mol/liter before nucleation, and then a halide solution having an $Ag^+$ content and $Cl^-$ content of from 30 to 100 mol % is added can be exemplified.

(3) A method of forming the defects in the presence of adsorbent $C^0$ (an organic compound having at least one nitrogen atom N having a resonance stabilized π electron pair) and forming the tabular seed crystals. Details of this method is disclosed in EP-A-0534395.

A method of forming the defects in the presence of adsorbent $C^1$ (an organic compound having two molecules or more, preferably from 4 to $10^3$ molecules, of adsorbent $C^0$ in one molecule by covalent bonding) and forming the tabular seed crystals:

A method of forming the defects in the presence of adsorbent $C^2$ (a compound having 2 or more, preferably from 4 to $10^4$, of alcohol groups in one molecule, excluding protein and compound $A^0$) or a cyanine dye and forming the tabular seed crystals: In these cases, it is thought that the defects are generated by the addition of $Ag^+$ and $X^-$ in such a state that adsorbent $C^1$ or adsorbent $C^2$ is adsorbed onto AgX grains, and tabular seed crystals are formed. The addition amount of these adsorbents is 0.002 g/liter or more, preferably from 0.01 to 150 g/liter, and more preferably from 0.1 to 50 g/liter. Details of these compounds and the preparation method of tabular grains are disclosed in JP-A-8-339044 and JP-A-10-177226. Imidacyanine and oxacyanine are preferably used as the cyanine dye.

(A2) Ripening and Growing Processes

The thus-formed tabular seed crystals are then ripened and grown. Alternatively, the seed crystals can be grown without ripening, but the former case is preferred. Concerning the details of ripening and growth, description in the above item (I-4), JP-A-8-339044, JP-A-6-308648, JP-A-7-234470 and JP-A-10-177226 can be referred to.

(I-6! Process after Grain Formation

After termination of grain formation, compound $A^0$ can be removed from the AgX emulsion, if unnecessary. Compound $A^0$ adsorbed onto the AgX grains is desorbed from the AgX grains and removed from the AgX emulsion by ordinary desalting process. If desalting process of the AgX emulsion is used, compound $A^0$ can be removed without increasing production process, which is preferred. The desorption of compound $A^0$ can be heightened by selecting emulsion conditions (combination of pH, $X^-$ concentration, temperature) and modifying compound $A^0$. As details thereof, description in (A4) of the above item (I-4) and the item (I-8) described later can be referred to. From 5 to 100%, preferably from 20 to 100%, of the amount of compound $A^0$ present in the AgX emulsion can be removed.

As the grain forming process has been completed in this case, compound $A^0$ can be exchanged with a strong adsorbent without hindrance. Accordingly, it is enough to add a strong adsorbent (e.g., a spectral sensitizing dye, an antifoggant or a dispersion medium having strong adsorbability), exchange with compound $A^0$ and desorb compound $A^0$. Although the desorption rate of compound $A^0$ can be heightened by gradually raising the $X^-$ concentration and the temperature, but grains are distorted when a strong adsorbent is not coexistent. However, the distortion can be prevented by the exchange adsorption by a strong adsorbent with the desorption of compound $A^0$. Accordingly, in this case, it is sufficient to gradually increase the $X^-$ concentration and the temperature in the presence of a strong adsorbent to realize the above-described method. Alternatively, the exchange adsorption rate with the exchange adsorbent can be increased in stages by repeating the procedure of (addition of the adsorbent→the exchange adsorption with compound $A^0$→setting up of the emulsion conditions) one time or more, preferably from 2 to 20 times. Alternatively, the procedure of (a part of compound $A^0$ is desorbed and removed from the emulsion by desalting→the adsorbent is added and adsorbed) can be repeated one time or more, preferably from 2 to 20 times.

Adsorbability of an antifoggant onto the AgX grains is largely influenced by the pH and the $X^-$ concentration of the AgX emulsion. The more the pH of the emulsion is lowered compared with the pKa value of the antifoggant, and the more the $X^-$ concentration is increased, the more is reduced the adsorbability of the antifoggant. It is also possible that after compound $A^0$ is exchange-adsorbed with an antifoggant by the above pH condition of (pKa−0.3) or more, compound $A^0$ is removed from the emulsion by desalting process, subsequently the antifoggant is desorbed by the pH condition of the above pKa or less, and then the antifoggant is removed from the emulsion again using desalting process.

The following producing processes can also be used: (1) grain formation ($b_1$)→washing of the emulsion with water ($b_2$) →chemical sensitization ($b_3$), spectral sensitization ($b_4$); (2) $b_1$→desorption process of compound $A^0$ ($b_5$) →$b_2$→$b_3$, $b_4$. Either $b_3$ may be carried out first or $b_4$ may be, or may be carried out two or more times alternately.

If the dyes have covered almost entirely the AgX grain surfaces, the succeeding chemical sensitization nucleation is often hindered. In such a case, it is preferred to conduct exchange adsorption with the dyes at the exchange adsorption rate of from 0 to 99%, preferably from 5 to 90%, and more preferably from 10 to 80%.

With respect to the desorption process of compound $A^0$, JP-A-10-177226 can be referred to. The desorption amount of compound $A^0$ can also be confirmed by the following method. The AgX emulsion is centrifuged, the supernatant is taken out, an enzyme is added, gelatin is hydrolyzed and made low molecular weight. In this case, the molecular weight lowering is further accelerated by using from two to ten kinds of enzymes, which is preferred. Enzymes are preferably those which do not decompose compound $A^0$. Compound $A^0$ is separated and detected from the solution by liquid chromatography or electrophoresis. Compound $A^0$ can also be detected by developing the color with an iodine solution.

(I-7! A method of generating isotropic growing defect by the adsorption of compound compound $A^0$ onto the AgX grains:

The tabular grain grows for the reason that the growing speed of the edge face of the tabular grain is faster than the growing speed of the main plane, and the cause thereof is that a substance which accelerates growing of the edge face (hereinafter referred to as "defect") is present on the edge face. The fact that the tabular grain grows by the glowing acceleration is apparent from the following, i.e., when a cubic grain having no defect (having the same size) is added to the defective grain to coexist with the defective grain, then $Ag^+$ and $Br^-$ are added and both grains are grown, the growing speed of the edge face of the tabular grain is faster than the growing speed of the regular crystal surface. Further, it is also apparent from the fact that the edge face of the tabular grain grows faster than the critical growing rate ($\mu$m/min.) of a cubic grain onto which compound $A^0$ is not adsorbed.

The substance of the defect has not been clarified yet and various assumptions can be thought as follows.

(1) Growth accelerating defects generally recognized in the field of crystallography are parallel multiple crystal defects having two or more parallel twin planes and screw dislocation defect. This is the concept that twin plane cannot get in on {100} face mechanically, therefore, the defect is nothing other than screw dislocation defect.

(2) When tabular grains are prepared by adsorbing a special adsorbent onto the AgX grains as in the present invention, the following models are thought.

(a1) A mode in which the adsorbent is adsorbed onto a certain crystal surface and assists the formation of a new growing nucleus without hindering the growth of the growing nucleus as shown in FIG. 1(*a*).

(a2) A mode in which the adsorbent is adsorbed onto a certain crystal surface and the adsorbent accelerates the growth of the adsorbed surface. That is, the adsorbent functions as a catalyst for accelerating the growing reaction. For example, as shown in FIG. 1(*b*), the adsorbent is thought to have a function of receiving $Ag^+$ and $X^-$ from the bulk solution phase and fix them on the crystal surface. (1)→(2)→(3) in FIG. 1 shows the growing process of the growing layer.

(a3) When $Ag^+$ and $X^-$ are laminated in the state of the adsorbent being adsorbed onto the AgX grain, the laminated position of $Ag^+$ and $X^-$ deviates from the normal position and a crystal defect is formed.

(a4) When $Ag^+$ and $X^-$ are laminated in the state of the adsorbent being adsorbed onto the AgX grain, the adsorbent is got into the grain and a crystal defect is formed. On the other hand, as the result of the experiment, when compound $A^0$ was adsorbed onto the AgX grain and then $Ag^+$ and $X^-$ were fed in various addition rate, the formation probability of tabular grains largely varied. From the above fact, it is thought that the deposit process of $Ag^+$ and $X^-$ on the AgX grain adsorbed with compound $A^0$ is necessary for forming the defect. Accordingly, it is presumed that the defects in the above items (a1) to (a4) are also formed through this process.

The defect is not such as to be generated by coalescence of already existing AgX grains with each other, because even if the emulsion is allowed to stand for a long period of time in the state without addition of compound $A^0$, the tabular grain does not appear. If compound $A^0$ is added to the grain, the possibility of the coalescence is further lowered.

Figure 2:
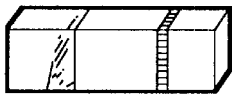
FIGS. 2(*a*)–(*g*) show examples of dislocation lines observed on the cross sections of tabular grains.
Figure 2:
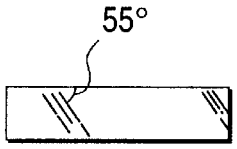
Figure 2:
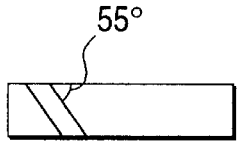
Figure 2:
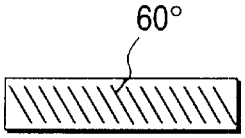
Figure 2:
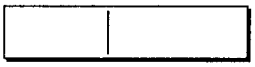
Figure 2:
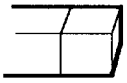
Figure 2:
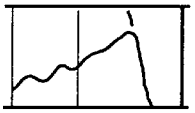

Tabular seed crystals are formed by the method described in (A1) of item (I-4) and grown by homogeneous AgX composition. The tabular grains are cooled at −100° C. or less and transmission type electron microphotographic images (hereinafter referred to as "TEM image") of the grains are observed. When TEM images are observed from every electron beam incident angle to the main planes of the tabular grains, dislocation lines are not observed. However, when the tabular grains are cut vertically to the main plane with a microtome to prepare hyperthin sections having a thickness of about 0.1 μm and the frozen TEM images thereof are observed, dislocation line images as shown in FIG. 2 (1) to (5) can be observed. These images are dislocation line images which cannot be seen in the same observation as regular crystals and parallel twin tabular grains. These images are characteristic in that they have many diagonal dislocation lines of angles of from 50 to 65° to the main plane also different from the dislocation line images in the same observation as tabular grains prepared by the method in (A1) of item (I-5).

FIGS. 2(*a*) and (*f*) are examples in which the main plane (1) and the cross section (2) of the sections are observed, in (b) to (e) only the cross section, and (g) is the example in which the cross section of thick grain is observed.

The most preferred observation method of TEM image is a method in which a grain is not cut but the side of a tabular grain is observed with the grain being inclined. Defect lines of various lengths are sometimes observed on the side, and the observed defect lines prove to be screw dislocation defects in this case.

(I-8) Others

Anisotropic growing defects can also be formed by the method of (A1) in item (I-4) and the method of (A1) in item (I-5) in combination. However, in the present invention it is essential that the projected area ratio of the tabular grains grown by the defects formed by the (A1) in item (I-4) obeys description in (I-2). It can be possible to form defects previously by the method of (A1) in item (I-4), subsequently further form defects by the method of (A1) in item (I-5), and increase the ratio of the number of grains having the defects, vice versa. From 90 to 100% in grain number of the tabular seed crystals prepared by the method of (A1) in item (I-4) are the grains whose four sides of four edges of the right angle parallelogram grow at variable rate, which is effective for changing this variable rate to constant rate. This can be confirmed by observing the low temperature TEM image of the tabular grain in which the halogen compositions of the growing phase are altered as annual rings one time or more during growing. Growth hysteresis can be seen from the TEM image of the place where halogen compositions are different due to the difference in the TEM image contrast.

Conditions which can be used in the processes in items (I-4) to (I-6) are described below. pH in these processes is from 1 to 12, preferably from 2 to 11, a pX value is from 0.7 to 5.0, preferably from 1.0 to 3.0, and the temperature is from 2 to 99° C., preferably from 10 to 90° C. As for methods of adding previously prepared AgX fine grains and splash methods, JP-A-4-34544, JP-A-2-166442, JP-A-6-3758, RD (1966), JP-B-4-43569, and U.S. Pat. No. 5,663,041 can be referred to. These fine grains are preferably non-defective fine grains and the preparation method of these fine grains is disclosed in JP-A-4-34544.

In the processes in items (I-4) to (I-6), the concentration of an AgX solvent can be used in the range of preferably from $10^{-7}$ to $10^{-1}$ mol/liter, more preferably from $10^{-6}$ to $10^{-2}$ mol/liter. The AgX solvent is a solvent which can form complexes with $Ag^+$ or $AgXn^{(1-n)}$, and can increase the concentration of these complexes in the solution to 1.2 times or more, preferably 2 times or more, e.g., $NH_3$, organic primary, secondary and tertiary amines, thioethers, thiourea derivatives, compounds having the thiocarbonyl group between an oxygen or sulfur atom and a nitrogen atom, imidazoles, sulfite, thiocyanate, hydroxyalkyl-substituted ethylene-diamines, substituted mercaptotetrazoles, and cyanate can be exemplified. JP-A-63-316847, JP-A-3-120528 and the literature described later can be referred to.

When an AgX solvent is present during the ripening process, the ripening is accelerated. When an AgX solvent is present during the growing process, and if the addition rate of $Ag^+$ and $X^-$ is the same at this time, the higher the concentration of the AgX solvent, the more is the low super-saturation degree described in (A3) of the above item (I-4). Further, when the AgX solvent is used in the above concentration in processes (A2) and (A3), Ostwald ripening is accelerated and the growth of the tabular grains is accelerated, which is preferred.

The concentration of a dispersion medium is from 0.01 to 150 g/liter, preferably from 0.1 to 50 g/liter, and the kind of $X^-$ is $F^-$, $Cl^-$, $Br^-$ or $I^-$, and $Cl^-$, $Br^-$ or $I^-$ is preferred. As acid and base as a pH adjustor and a pH buffer, *Gendai Butsuri Kagaku Koza* (*Modern Physical Chemistry Course*), Vol. 8, Chap. 9, Tokyo Kagaku Dojin (1968), *Koza Yuki Hanno Kiko* (*Course of Organic Reaction Mechanism*, Vol. 1, Tokyo Kagaku Dojin (1965), *Kagaku Binran* (*Chemistry Handbook*), 4th revised edition, elementary course, Chap. 10, Maruzen Co., Ltd. (1993) can be referred to.

If the AgX solvent becomes unnecessary after ripening or growing, it is possible to take a treatment of nullifying the AgX solvent, e.g., the solvent can be inactivated by Adding $NH_3$, or acid when the solvent is organic amines, to reduce the pH of the solution preferably to (pKa of the compound−0.3) or less, more preferably (pKa of the compound−0.6) or less. Herein, pKa is −log [Ka] (Ka is an acid dissociation constant) When the solvent is a thioether-containing compound, an oxidizing agent is added to change the thioether group to a sulfoxide group or a sulfonyl group, thus the solvent is inactivated. Concerning oxidizing agents, the following description can be referred to, and $H_2O_2$ is more preferably used. Further, the AgX solvent can be removed from the emulsion by the desalting method described later. From 30 to 100%, preferably from 50 to 100%, and more preferably from 75 to 100%, of the existing AgX solvent can be removed from the emulsion by these methods.

As desalting methods of AgX emulsion, a noodle washing method, a dialysis method, an ion exchange resin method, a method of coagulation precipitating the emulsion by adding a precipitant, a method of making use of the coagulation precipitation property of a modified gelatin such as phthalated gelatin near the pH of isoelectric point, an electrolysis method, an ultrafiltration method, a centrifugation method, a centrifugal filtration method, and a hydrocyclone method can be exemplified, and as to details thereof, RD, (1966) and the literature described later can be referred to.

As for a centrifugation method, a centrifugal filtration method and apparatus, *Zoho Enshin Bunri* (*Centrifuqation, Enlarged Edition*), Kagaku Kogyo Co., Ltd. (1985), *Bunri Seisei Giiutsu Handbook* (*Technical Handbook of Separation and Purification*), Chap. 9, Maruzen Co., Ltd. (1993), *Kagaku Kiki Soran* (*Comprehensive Bibliography of Chemical Apparatus*), 96/97, pp. 619 to 649, Tokyo Chemical Apparatus Association (1998) can be referred to.

When a large amount of compound $A^0$ is existing in an AgX emulsion, the emulsion sometimes precipitates with difficulty even if a precipitant is added. In such a case, =sometimes precipitation is accelerated by the addition of from 0.1 to 100 g/liter, preferably from 1.0 to 30 g/liter, of polyvinyl alcohol having a polymerization degree of from 10 to $10^4$, preferably from 50 to 3,000, and this method is preferably used.

As spectral sensitizing dyes, cyanine dyes are preferably used, e.g., a cyanine dye, a merocyanine dye, a complex cyanine dye, a complex merocyanine dye, a holopolar cyanine dye, a hemicyanine dye, a styryl dye, and a hemioxonol dye. Spectral sensitizing dyes having a grain size of from 0.01 to 10 $\mu$m can be used alone or a combination of one or more, preferably from 1 to 10, as a solution, or mixture with a dispersion medium or a surfactant or a mixture with a solution containing a dispersion medium or a surfactant. The addition amount of the dyes can be from 1 to 120%, preferably from 10 to 98%, of the saturation adsorption amount.

Examples of antifoggants include imidazoles, benzimidazoles, thiazoles, triazoles, tetrazoles, azaindenes, mercaptotetrazoles, triazines, pyrimidines and triazines.

With respect to oxidizing agents, reducing agents and reduction sensitizers which can be used in the process, *Shin-Jikken Kagaku Koza* (*New Experimental Chemistry*), Vol. 15, "Sanka to Kangen (Oxidation and Reduction)", Maruzen Co., Ltd. (1976), and *Kagaku Dai-Jiten*, items of "Oxidizing Agent" and "Reducing Agent", Kyoritsu Publishing Co., Ltd. (1963), *Kagaku Binran* (*Chemistry Handbook*, 4th Ed. (revised), Elementary Course, Chap. 12, Maruzen Co., Ltd. (1993), JP-A-7-311428, JP-A-6-67326, JP-A-10-177226, and RD, (1996), and the literature described later can be referred to.

The order of the easiness to be reduced of $Ag^+$ by a reducing agent is [$Ag^+$>AgCl>AgBrCl>AgBr>AgBrI>AgI], which is the order of the size of a of $Ag^{+a}$. Generally describing, it can be said that the larger the a is, the larger the easiness to be reduced of $Ag^{+a}$ in (Ag . . . Y) complex is. Here, Y represents ligands containing inorganic or organic atoms, ions, or molecules. The order of the size of a is the order of the size of standard electrode potential. This guiding principle can be applied to the AgX grains and general grains, and it can be said that the larger the positive electric charge density (number of charges/the surface, or, number of charges/the volume) of the positive electric charge grains adsorbed by $Ag^+$, the more easily is the grains to be reduced. At this time, a conduction band mainly comprising $Ag^+$ is bound to be low. On the other hand, the larger the negative electric charge density of the negative electric charge grains adsorbed by $X^-$, the more hardly is the grains to be reduced.

This can be confirmed by ripening the AgX grains at pH of from 9 to 13, the temperature of from 30 to 80° C., preferably from 40 to 70° C., for 5 to 180 minutes, preferably from 10 to 120 minutes, measuring the diffuse reflectance spectrum of them (region of wavelength of from 370 to 800 nm), and comparing the increased degree of light absorption in visible region.

The degree of reduction of the AgX grains can be obtained by making up the pH of the emulsion, the concentration of $X^-$, the temperature, the kind of the dispersion medium, and the concentration of the dispersion medium, putting a noble metal (a platinum group, e.g., gold or platinum, preferably platinum) electrode in the emulsion, and measuring the noble metal potential to the reference electrode. This can also be obtained by centrifuging the AgX grains, removing the supernatant, dispersing the emulsion in water again, and measuring the potential of the emulsion.

Well-known water-soluble dispersion media excluding specific dispersion media can be used as a water-soluble dispersion medium in this process. Specific dispersion media means compound $A^0$ and dispersion media having a polyvinyl alcohol moiety of polymerization degree of 200 or more in the molecule. Gelatin is preferably used as a dispersion medium, and every kind of gelatin of every animal can be used. The molecular weight of a dispersion medium is preferably from 1,000 to $10^6$, more preferably from 3,000 to $3\times10^5$. Variation coefficient of the molecular weight distribution (standard deviation of weight average molecular weight distribution/weight average molecular weight) is preferably from 0.01 to 0.6, more preferably from 0.02 to 0.40, and still more preferably from 0.02 to 0.20. As one example of gelatin having narrow distribution, divided gelatin by ultrafiltration can be exemplified, and *Nihon Shashin Gakkai-Shi* (*Bulletin of Japan Photographic Society*), Vol. 60, pp. 19 to 27 (1997) can be referred to. The methionine content of a dispersion medium is preferably from 0 to 100 $\mu$mol/g, more preferably from 0 to 60 $\mu$mol/g.

A dispersion medium can be added to one or more, preferably both, of the $Ag^+$ solution and $X^-$ solution to be used in this process, and the concentration thereof is preferably from 0.01 to 10 g/liter, more preferably from 0.1 to 3.0 g/liter.

With respect to well-known water-soluble dispersion medium, gelatin, chemically modified protein and chemically modified gelatin, the following patent and literature can be referred to: JP-A-8-82883, *Nihon Shashin Gakkai-Shi* (*Bulletin of Japan Photographic Society*), Vol. 58, pp. 25 to 30 (1995), *Nikawa to Gelatin* (*Glue and Gelatin*), Chap. 4, Glue and Gelatin Industrial Association of Japan (1987), *The Science and Technology of Gelatin*, Chap. 7, Academic Press (1977), *Shin Seikagaku Gikken Koza* 1 (*New Biochemical Experimental Course* 1), "Proteins IV", Tokyo Kagaku Dojin (1991), *Application and Market of Water-Soluble High Polymer*, CMC (1984), *Suiyo-sei Kobunshi* (*Water-Soluble High Polymer*), Kagaku Kogyo Co., Ltd. (Edition of 1991), and RD, (1997). When two or more functional groups are chemically modified, for example, after an amino group has been modified selectively, a thioether group can be oxidized by adding an oxidizing agent, or after a thioether group has been oxidized, an amino group can be modified. Further, after an amino group has been modified, one or more of an imidazole group, a guanidyl group and a hydroxyl group can be modified. Representative examples of chemical modification of an amino group include benzoylation, phthalation, trimellitation, succination, sulfonation (e.g., a method of using propanesultone, butanesultone), and acetylation.

A dispersion medium can be newly added during the period of time after seed crystal formation until the termination of grain growth. The addition amount of a dispersion medium is preferably from 0.01 to 150 g/liter, more preferably from 0.1 to 100 g/liter. Further, it is preferred to conduct the treatment of reducing the complex-forming capability with $Ag^+$ of the dispersion medium to 1 to 90% of the original capability, preferably the treatment of reducing the complex-forming capability of the dispersion medium aqueous solution, at pH of from 2 to 4, to 3 to 70% of the original capability, during the period of time after 1 minute from the beginning of seed crystal formation until 3 minutes before the termination of the grain growth, preferably during the period of time after seed crystal formation until prior to grain growth. Specifically, the thioether group of the dispersion medium can be oxidized by the addition of an oxidizing agent, or one or more of the thioether group, amino group or imidazole group of the dispersion medium can be chemically modified. The oxidation rate and the modification rate is from 3 to 100%, preferably from 10 to 90%. Adsorption strength of the dispersion medium onto the AgX grains is weakened by these treatment and the $X_5$ value of the tabular grains is heightened, as a result, tabular grains having a higher aspect ratio can be obtained. Details thereof are disclosed in JP-A-7-311428.

When $B^1$ moiety is adsorbed onto cubic AgBr, octahedral AgBr, or cubic AgCl grains, the ionic conductivity of the grains is increased, this is presumably due to the exchange adsorption of AgX grains with gelatin. A thioether group of methionine has the strongest adsorption strength in gelatin molecules, in general, and next are the imidazole group and the amino group, and all of these adsorbing groups reduce the ionic conductivity of the AgX grains. This is thought to be based on the fact that these groups are desorbed or the fact that the adsorption by the interaction of dipole-dipole of $Ag^+$—$X^-$ with an —OH group or —OH . . . O— hardly transforms the ionic conductivity. This is an example of a mechanism of a certain compound adsorbed onto the AgX grains increases the ionic conductivity of the grains. It is thought that such a mechanism also contributes to sensitivity and image quality.

When $Ag^+$ or $X^-$ is added to an aqueous solution containing only PVA and the relationship between the silver potential of the aqueous solution (to calomel electrode) with the addition amount of $Ag^+$ or $X^-$ is examined, it is almost the same with the relationship in an aqueous solution not containing PVA at pH from 3 to 10. This relationship is almost the same with an aqueous solution containing from 1/10 to 10/1 by weight ratio of gelatin and PVA and an aqueous solution from which PVA is removed at pH from 6 to 10, therefore, it is thought that the interaction of PVA and $Ag^+$ or $X^-$ is hardly exists.

With respect to the modification of compound $A^0$, JP-A-8-339044 can be referred to. The selection of compound $B^0$ can be performed according to the method disclosed in JP-A-8-339044, e.g., a method of finding the relationship between the silver potential and the shape of the grains when regular crystal AgBr emulsion grains having a grain size of 0.2 μm is grown to a certain volume with maintaining the silver potential of the solution constant. This means the compound which gives the relationship of the silver potential of capable of obtaining tetradecahedral grains of the same shape is shifted to low potential side by 10 mV or more, preferably by 20 to 150 mV, more preferably by 50 to 100 mV, due to the presence of compound $B^0$. As compound $B^0$ also has a characteristic of adsorbing onto {100} faces of AgX grains selectively, selection can also be effected by examining this characteristic. As a selecting means, for example, a method of putting a cubic AgX emulsion-coated substance and an octahedral AgX emulsion-coated substance in a solution containing compound $B^0$, then taking out them and comparing the adsorbed amount of compound $B^0$ onto both substances can be exemplified. Concerning this method, JP-A-8-20696 can be referred to.

In many cases, the adsorption strength of the adsorbent adsorbed onto the AgX grains follows the following guiding principle. When a hydrophobic group is covalent bonded to an adsorbent, the higher the hydrophobicity of the group, the stronger is the adsorption strength. On the other hand, when a hydrophilic group is bonded to an adsorbent, the higher the hydrophilicity of the group, the weaker is the adsorption strength. The number of a divalent chalcogenide atom (e.g., S, Se, Te) increases the more, the adsorption strength increases the more. The larger the complex-forming stabilization constant with $Ag^+$, the larger is the adsorption strength. The hydrophilic groups and the hydrophobic groups are disclosed in *Kagaku Jiten* (*Chemical Dictionary*), item of "Hydrophilic Groups, Hydrophobic Groups, Hydrophobic Compounds", Tokyo Kagaku-Dojin (1994), *Kagaku Dai-Jiten*, item of "Hydrophilic Groups", Kyoritsu Publishing Co., Ltd. (1961), *Kaimen-Kasseizai Binran* (*Handbook of Surfactants*), Chap. 7, Sangyo Tosho Co., Ltd. (1960).

A sensitizing dye can be added to the reaction system by dissolving the dye in water, an organic solvent, or mixture of them, or can be added in the form of a dispersion by dispersing the dye powder (particle size: from 0.01 to 10 μm, preferably from 0.01 to 1.0 μm) in a water-soluble dispersion medium, a surfactant, or an aqueous solution containing a water-soluble dispersion medium and a surfactant.

The strongest adsorptive group in gelatin molecules is a methionine group and the next is an imidazole group. This fact means that the interaction between AgX grains and gelatin molecules when pH and pAg of an AgX emulsion are changed variously is not mainly Klein-Moiser type Coulomb interaction but is mainly coordinate bond of the methionine group and $Ag^+$.

The main component of the solvent of a dispersion medium solution is water, generally from 70 to 100%, preferably from 90 to 100%, of the solvent is water. Besides water, an organic solvent can be contained. With respect to organic solvents, *Pocket Book of Solvent*, New Edition, Ohm Sha (1994) can be referred to.

With respect to dispersion media and molecular weight division and high purification of compound $A^0$, *Bunri Kagaku Handbook* (*Handbook of Science of Separation*), Kyoritsu Publishing Co., Ltd. (1993) can be referred to.

Figure 3:
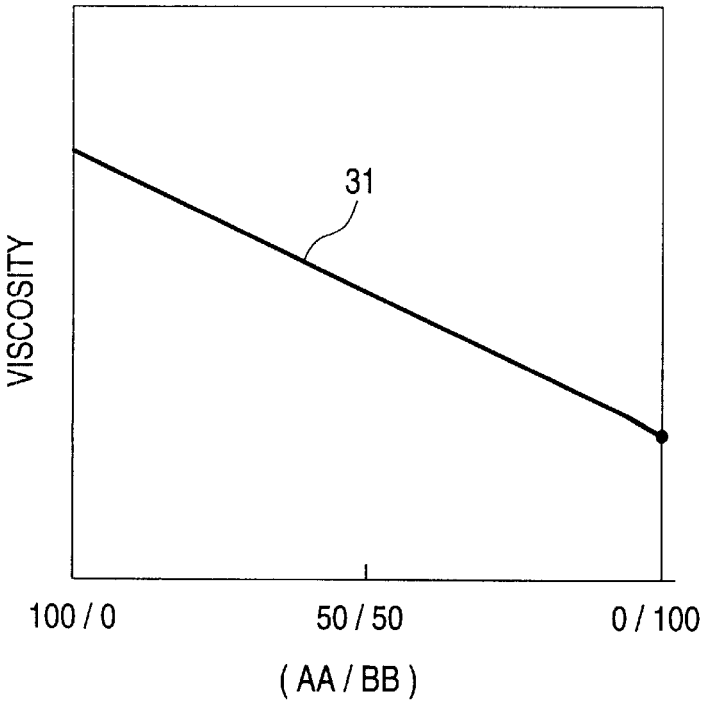
FIG. 3 shows the relationship between the mixing ratio of solution AA/solution BB and the viscosity of the solution.

In the processes in the above items (I-4) to (I-6), a modifier for modifying the action of compound $A^0$ can be added in an amount of from 0.01 to 100 g/liter, preferably from 0.1 to 30 g/liter. This modifier means a compound which interacts with compound $A^0$ intermolecularly, and increases the solution viscosity to 1.05 to 100 times, preferably from 1.2 to 30 times, when added to a 5.0 wt % aqueous solution of compound $A^0$ in the above amount as compared with the system not showing the intermolecular interaction. When solutions are prepared by solution AA and solution BB in various ratios of the liquid amount in FIG. 3, the viscosity of the system not showing the intermolecular interaction is shown by line 31. In FIG. 3, the axis of abscissa indicates the mixing ratio of both solutions and the axis of ordinate indicates the viscosity (pascal·sec.) of the solution. As specific examples of the compounds, preferred compound can be used by selecting from among boric acid, borax, polyacrylamide (molecular weight: 500 to $10^6$), the above-described water-soluble dispersion media, surfactants, and antifoggants.

In addition, as to the above items generally, the literature described in item (I-3), JP-A-8-339044, JP-A-10-177226, compiled by Ichiro Sakurada, *Polyvinyl Alcohol*, in particular, pp. 89 to 99, compiled by Kobunshi Gakkai (1955) can be referred to.

Epitaxial grains may be formed using the obtained grains as a host grain. Further, grains having dislocation lines of various shapes inside may be formed using the obtained grains as a core. In addition, using the obtained grains as substrates, a variety of grains having various well-known grain structures can be used by laminating AgX layers having halogen compositions different from the composition of the substrates. With respect to techniques thereof, the later-described literature can be referred to.

As a dislocation defect-forming method, a method of forming a halogen composition gap plane on the AgX grain as described in (A1) of item (I-5), a method of adding alone or a plurality of $Br_2$ and $I_2$ to an emulsion, adding a reducing agent to generate $X^-$, and inducing halogen conversion on the core grain can be exemplified.

A shallow internal latent image type emulsion may be formed using the tabular grain as a core. A core/shell type internal latent image type grain can also be formed.

The AgX grain emulsion produced can be used by blending with other one or more AgX emulsions, or two or more emulsion grains having different grain sizes of the present invention may be blended. The blending ratio (mol of guest AgX emulsion/mol of AgX emulsion after blending) can be arbitrarily optimally selected preferably from the range of from 0.99 to 0.01. Additives which can be added during the period of time of before the beginning of the grain formation until the termination of the coating and the addition amounts thereof are not particularly restricted, and conventionally well-known every photographic additive can be used in the optimal addition amount. Examples of such additives include an AgX solvent, a doping agent to AgX grains (e.g., noble metals belonging to group VIII, other metal compounds, chalcogen compounds, SCN compounds), a dispersion medium, an antifoggant, a sensitizing dye (for blue, green, red, infrared, panchromatic, orthochromatic), a supersensitizer, a chemical sensitizer (alone or in combination of two or more of sulfur, selenium, tellurium, gold and noble metal compounds belonging to group VIII, phosphorus compounds, thiocyanate compounds, and reduction sensitizers), a fogging agent, an emulsion precipitant, a surfactant, a hardening agent, a dye, a dye image-forming agent, additives for a color photograph, a soluble silver salt, a latent image stabilizer, a developing agent (hydroquinone-based compounds), a pressure desensitization inhibitor, a matting agent, an antistatic agent, a dimensional stabilizer, etc.

The AgX emulsion prepared according to the present invention can be used in conventionally well-known every photographic material. For example, the AgX emulsions prepared according to the present invention can be used for black-and-white silver halide photographic materials (e.g., an X-ray photographic material, a photographic material for printing, a photographic paper, a negative film, a microfilm, a direct positive photographic material, an ultrafine grain photographic dry plate material (for LSI photomask, shadow mask, liquid crystal mask)), for color photographic materials (e.g., a negative film, a photographic paper, a reversal film, a direct positive color photographic material, a photographic material for a silver dye bleach process). In addition, the AgX emulsion according to the present invention can be used for diffusion transfer photographic materials (e.g., a color diffusion transfer element, a silver salt diffusion transfer element), heat-developing photographic materials (black-and-white and color), high density digital recording materials, and photographic materials for holography. The coating amount of silver is 0.01 $g/m^2$ or more, and desired amount can be selected.

There are no restrictions on the preparing method of the AgX emulsion (grain formation, desalting, chemical sensitization, spectral sensitization, methods of addition of photographic additives) and the apparatus, AgX grain structure, a support, an undercoating layer, a surface protective layer, the constitution of a photographic material (e.g., layer constitution, the molar ratio of silver/coupler, the silver amount ratio between each layer), the form and storing method of a photographic material, an emulsified dispersion of photographic additives, exposure, and developing method, and every conventionally well-known technique and mode, or every technique and mode which will be well-known in the future. Concerning details of these, the following literature can be referred to: *Research Disclosure*, Vol. 176 (Item 17643) (December, 1978), ibid., Vol. 307 (Item 307105) (November, 1989), G. F. Duffin, *Photographic Emulsion Chemistry*, The Focal Press, New York (1966), E. J. Birr, *Stabilization of Photographic Silver Halide Emulsion*, The Focal Press, London (1974), T. H. James, *The Theory of the Photographic Process*, 4th Ed., Macmillan, New York (1977), P. Glafkides, *Chimie et Physique Photographique*, 5th Ed., Edition del. Usine Nouvelle, Paris (1987), ibid., 2nd Ed., Paul Montel, Paris (1957), V. L. Zelikman, et al., *Makinq and Coating Photographic Emulsion*, The Focal Press (1964), K. R. Hollister, *Journal of Imaging Science*, Vol. 31, pp. 148 to 156 (1987), J. E. Maskasky, ibid., Vol. 30, pp. 247 to 254 (1986), ibid., Vol. 32, pp. 160 to 177 (1988), ibid., Vol. 33, pp. 10 to 13 (1989), H. Frieser, *Die Grundlagen der Photographischen Prozesse mit Silverhalogeniden*, Akademische Verlagsgesellshaft, Frankfurt (1968), *Monthly Bulletin of Nikkakyo*, pp. 18 to 27 (December, 1984), *Nihon Shashin Gakkai-Shi* (*Bulletin of Japan Photographic Society*), Vol. 49, pp. 7 to 12 (1986), ibid., Vol. 52, pp. 144 to 166 (1989), ibid., Vol. 52, pp. 41 to 48 (1989), JP-A-58-113926 to 113928, JP-A-59-90841, JP-A-58-111936, JP-A-62-99751, JP-A-60-143331, JP-A-60-143332, JP-A-61-14630, JP-A-62-6251, EP-A-0699944 to 0699951, JP-A-1-131541, JP-A-2-838, JP-A-2-146033, JP-A-3-155539, JP-A-3-200952, JP-A-3-246534, JP-A-4-34544, JP-A-2-28638, JP-A-4-109240, JP-A-2-73346, JP-A-5-341417, JP-A-4-193336, JP-A-7-181620, JP-A-6-215513, other Japanese patents, U.S. patents, European patents, and WO concerning AgX photographic field, *Journal of Imaging Science, Journal of Photoqraphic Science, Photographic Science and Engineering, Nihon Shashin Gakkai-Shi, Antholoqy of Lectures of Nihon Shashin Gakkai, Antholoqy of Lectures of International Conqress of Photographic Science, Antholoqy of Lectures of the International East-West Symposium on the Factors Influencinq Photoqraphic Sensitivity*, JP-A-10-177226 and JP-A-8-54701.

The emulsion according to the present invention can be preferably used as a constituting emulsion of a coated film in the examples of JP-A-62-269958, JP-A-62-266538, JP-A-63-220238, JP-A-63-305343, JP-A-59-142539, JP-A-62-253159, JP-A-1-131541, JP-A-1-297649, JP-A-2-42, JP-A-1-158429, JP-A-3-226730, JP-A-4-151649, JP-A-6-27590, and EP-A-0508398.

The present invention is described in detail below with reference to examples but the present invention is not limited thereto.

EXAMPLE 1

In a reaction vessel was added gelatin solution 1 [containing 1,200 ml of $H_2O$, 25 g of deionized alkali-processed ossein gelatin (hereinafter referred to as "EBG1") having a methionine content of 45 $\mu$mol/g, 12 g of compound 3 shown in Table 1, pH was adjusted to 7.0 with a 1 N NaOH solution, temperature: 75° C., and silver potential was adjusted to 50 mV (to a saturated calomel electrode at room temperature) with KBr-1 solution (containing 100 g/liter of KBr)] and, with stirring, Ag-1 solution (containing 100 g/liter of $AgNO_3$) and X-1 solution (containing 71.3 g/liter of KBr) were simultaneously added at a feeding rate of 3.5 ml/min. for 3 minutes, subsequently Ag-1 solution and X-1 solution were simultaneously added at a feeding rate of 3.5 ml/min. for 97 minutes with maintaining silver potential of 50 mV to a saturated calomel electrode. After mixing the solution for 2 minutes, the temperature was lowered to 60° C. After adjusting pH to 6.5 and silver potential to 50 mV, gold sensitizer 1 (an aqueous solution of 1/20 by molar ratio of chloroauric acid/NaSCN) in an amount of $1.0\times10^{-5}$ mol/mol-AgX, then chalcogenide sensitizer Sxl was added in an amount of $2\times10^{-5}$ mol/mol-AgX, and the solution was ripened for 20 minutes. Then, sensitizing dye 1 was added in an amount of 85% of the saturation adsorption amount, pH was adjusted to 4.0 with an $HNO_3$ solution, silver potential was lowered to 0 mV at a rate of about 5 mV/min. using KBr-1 solution, then the reaction solution was ripened for 30 minutes, and exchange adsorption of compound 3 and sensitizing dye 1 was accelerated.

Figure 4:
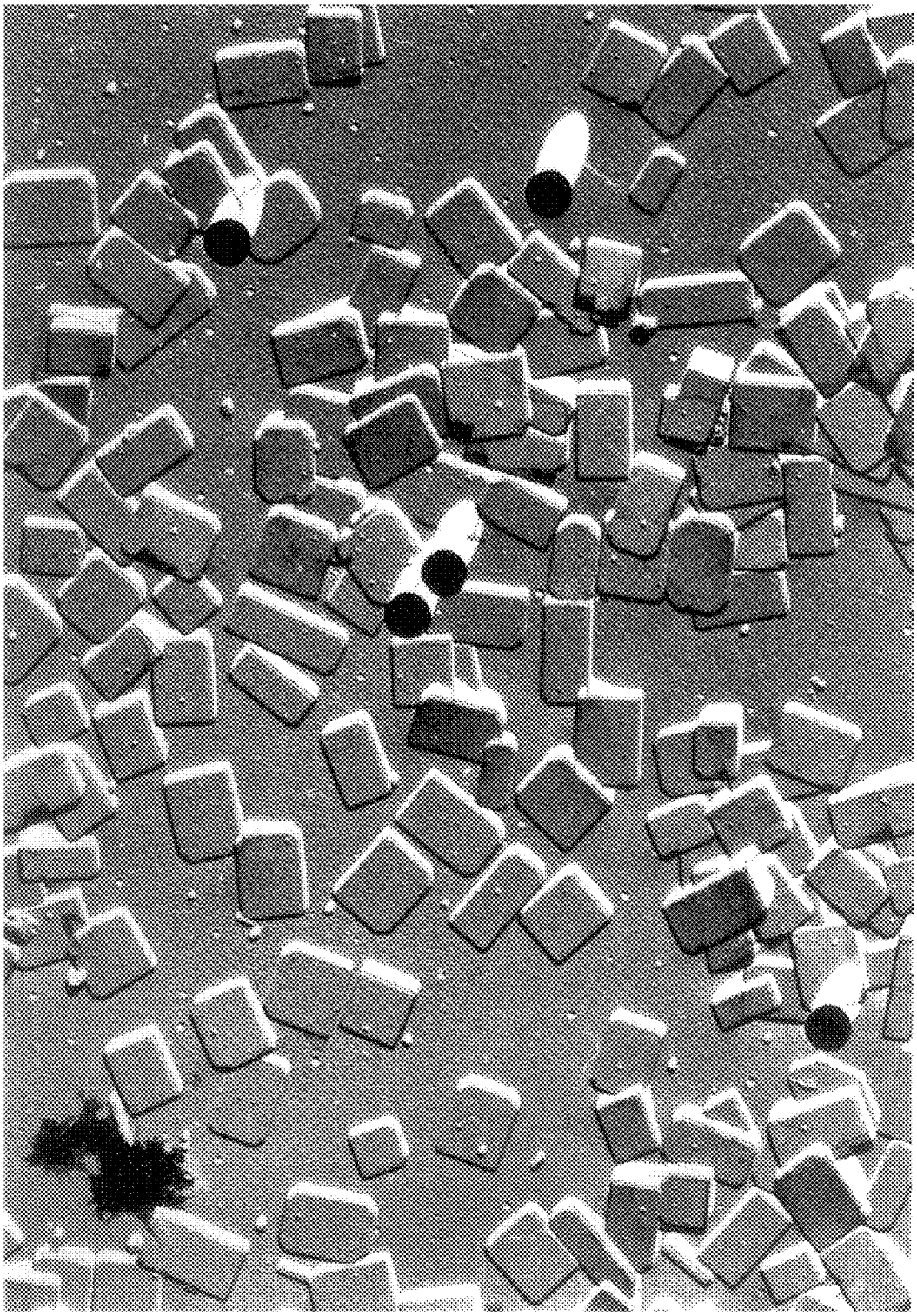
FIG. 4 is an electron microphotograph showing the crystal structure of tabular grains obtained in Example 1. Magnification is 12,700-fold.

TEM image of the replica of the emulsion grains picked at this point was observed. The results are shown in Table 2 and a photograph of the grain structure of magnification of 12,700-fold is shown in FIG. 4. Column (a) in Table 2 shows a projected area ratio of tabular grains having an aspect ratio (diameter/thickness) of 3.0 or more, an aspect ratio (long side length/short side length) of from 1 to 3.5, to the entire projected area of the AgX grains.

Subsequently, a precipitant was added to the emulsion, the temperature was lowered to 35° C., and the emulsion was washed three times by a precipitation washing method and soluble salts, desorbed substance of compound 3 and free dyes were removed from the emulsion, provided that washing water used in the first time and the second time was water having pBr of 2.3. A gelatin solution was added to the resulted emulsion, the temperature was raised to 40° C., pH and pBr were adjusted to 6.4 and 2.5, respectively, and the emulsion was dispersed again.

Sensitizing Dye 1

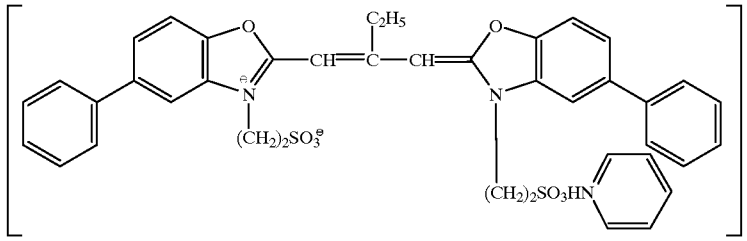

Sx1

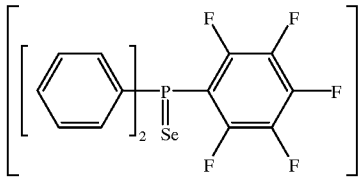

Mixing ratio of 1/2 of this compound/$Na_2S_2O_3$

F1

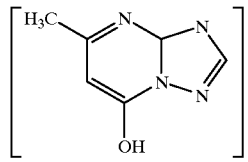

F2

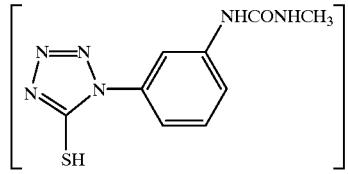

Sensitizing Dye 2

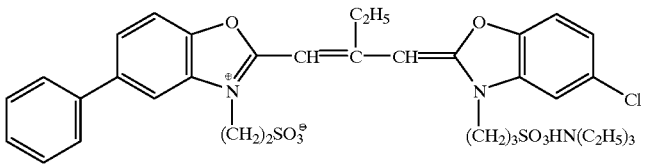

EXAMPLE 2

In a reaction vessel was added gelatin solution 2 (the same as gelatin solution 1 except for changing the addition amount of compound 3 of gelatin solution 1 to 6.0 g) and, with stirring, Ag-1 solution and X-1 solution were simultaneously added at a feeding rate of 3.5 ml/min. for 3 minutes, subsequently, Ag-1 solution and X-1 solution were simultaneously mixed at a feeding rate of 3.5 ml/min. for 27 minutes with maintaining the potential of 50 mV with Ag-1 solution. Then, 1.5 ml of a 5 wt % solution of $HO(CH_2)_2$—S—$(CH_2)_2$—S—$(CH_2)_2OH$ was added as an AgX solvent, and Ag-1 solution and x-2 solution (containing 0.98 g/liter of KI and 71 g/liter of KBr) were simultaneously added for 90 minutes with maintaining the potential of 60 mV. The feeding rate of Ag-1 solution was 5.0 ml/min. After mixing the solution for 3 minutes, the temperature was lowered to 60° C., and 7 ml of KI-1 solution (containing 100 g/liter of KI) was added. Subsequently, a precipitant was added to the emulsion, the temperature was lowered to 35° C., and the emulsion was washed by a precipitation washing method. The temperature was raised to 40° C., and pH and pBr were adjusted to 6.4 and 2.6, respectively, and the emulsion was dispersed again.

The temperature was raised to 60° C., S×1 was added in an amount of $2\times10^{-5}$ mol/mol-AgX, further, gold sensitizer 1 was added in an amount of $1.0\times10^{-5}$ mol/mol-AgX, and the emulsion was ripened for 20 minutes. Then, sensitizing dye 1 was added in an amount of 85% of the saturation adsorption amount. Subsequently, pH was adjusted to 4.0 and the potential to 0 mV, the reaction solution was ripened for 30 minutes, and exchange adsorption of compound 3 and sensitizing dye 1 was accelerated. A precipitant was added, the temperature was lowered to 35° C., the emulsion was washed by a precipitation washing method in the same manner as in Example 1. A gelatin solution was added to the resulted emulsion, the temperature was raised to 40° C., pH and pBr were adjusted to 6.4 and 2.5, respectively, and the emulsion was dispersed again.

EXAMPLE 3

The procedure of Example 2 was followed until the simultaneous addition of Ag-1 solution and X-1 solution for 27 minutes (in this example, 10 g of compound 2 was used in place of compound 3). Then, the temperature was lowered to 50° C., 1.0 ml of a 31 wt % solution of $H_2O_2$ was added and allowed to stand for 40 minutes. After 40 minutes, the temperature was again raised to 75° C., and pH was adjusted to 8.5, Ag-1 solution and X-1 solution were simultaneously added for 80 minutes with maintaining the potential of 50 mV. The feeding rate of Ag-1 solution was 5.0 ml/min. After mixing the solution for 3 minutes, the temperature was lowered to 60° C. Hereafter the procedure was the same as in Example 2.

Each of the finally obtained AgX emulsions in Examples 1 to 3 was picked in an amount of 10 ml, $Na_2S_2O_2$ was added to each emulsion and AgX grains were dissolved and inorganic ions were removed by an electrolysis method. $H_2O$ was added to make 100 ml, and 5.0 ml of which was taken. Then, an iodine solution (containing $2.0\times10^{-1}$ mol/liter of KI and $5.0\times10^{-2}$ mol/liter of $I_2$) was added and mixed, the emulsion was cooled to 10° C., the emulsion was colored by an iodostarch reaction and spectral absorbance was measured. The residual amounts of compounds 2 and 3 in the emulsion was found by comparing the density of compound 3 with the analytical curve of the relationship of the colored spectral strength. Each value in Examples 1 to 3 was 5% or less.

Comparative Examples 1 to 3

Comparative emulsions 1 to 3 were prepared in the same manner as in Examples 1 to 3, respectively, except for using compound 1 in place of compound 3 in the equimolar amount. TEM image of the replica of each of the AgX grains obtained was measured. The results obtained are shown in Table 2.

EXAMPLE 4

In a reaction vessel was added gelatin solution 3 [containing 1,200 ml of $H_2O$, 25 g of EBG1, temperature: 32° C., pH was adjusted to 4.0 with an $HNO_3$ solution, containing 12 ml of NaCl-1 solution (NaCl: 100 g/liter)] with stirring, Ag-1 solution and X-4 solution (containing 34.6 g/liter of NaCl) were simultaneously added at a feeding rate of 30 ml/min. for 2 minutes. Ten seconds after, 50 ml of a 6.0 wt % solution of compound 2 was added and the temperature was raised to 75° C. pH was adjusted to 6.0 with an NaOH solution, and silver potential was adjusted to 100 mV with NaCl-1 solution, and Ag-1 solution and X-4 solution were simultaneously added for 100 minutes with maintaining the silver potential of 100 mV. The feeding rate of Ag-1 solution was 5 ml/min. After mixing the solution for 3 minutes, the temperature was lowered to 60° C., and 10 ml of KBr-1 solution (containing 100 g/liter of KBr) was added, and the emulsion was mixed for 5 minutes. Subsequently, 5 ml of KI-1 solution was added and mixed for 5 minutes.

Dye 1 was added in an amount of 60% of the saturation adsorption amount, and mixed for 10 minutes. Thereafter, S×1 was added in an amount of $2\times10^{-5}$ mol/mol-AgX, further, gold sensitizer 1 was added in an amount of $2\times10^{-6}$ mol/mol-AgX, and the emulsion was ripened for 15 minutes. Then, sensitizing dye 1 was added in an amount of 25% of the saturation adsorption amount, pH of the emulsion was adjusted to 4.0 with an $HNO_3$ solution, silver potential was lowered to 90 mV at a rate of 2 mV/min. with NaCl-1 solution, then the emulsion was ripened for 30 minutes, and exchange adsorption of compound 2 and sensitizing dye 1 was advanced. A precipitant was added to the emulsion, the temperature was lowered to 35° C., and the emulsion was washed by a precipitation washing method. A gelatin solution was added to the resulted emulsion, the temperature was raised to 40° C., pH was adjusted to 6.2, and NaCl concentration was adjusted to $10^{2.4}$ mol/liter and the emulsion was dispersed again.

EXAMPLE 4A

AgX emulsions were prepared in the same manner as in Example 4 except for using compound 10 in place of compound 2 in the equimolar amount. Each emulsion was desalted and dispersed again. TEM image of the replica of each of emulsion grains obtained was observed. The results obtained are shown in Table 2. Compound 10 was prepared as follows.

In a glass container was added 1.0 liter of a 6.0 wt % aqueous solution of compound 2 (40° C., pH: 4.8), and then 6.0 ml of a 3.1 wt % solution of $H_2O_2$ was added, with stirring. After mixing the solution homogeneously, the container was capped and put in a thermostatic chamber at 40° C. and allowed to stand for 17 hours. Subsequently, a 2 N NaOH solution was added thereto and pH was adjusted to 6.0, and then $H_2O$ was added to make the total amount 1,200 g. An $MnO_2$ powder (particle diameter: from 50 to 200 $\mu$m) was added in an amount of 0.3 g, and the solution was stirred for 3 hours at 40° C. to decompose the remaining $H_2O_2$. The solution was centrifuged and the supernatant was taken out. The thus-obtained solution was designated $2Z^2$ solution. The necessary amount of $2Z^2$ solution was put in a reaction vessel and used for grain formation.

A solution of compound 2 was prepared in the same manner as the preparation of $2Z^2$ solution except that $H_2O_2$ and $MnO_2$ were not added. The thus-obtained solution was designated $2Z^1$ solution. The relationship between the silver potential (to a saturated calomel electrode) and the addition amount of $AgNO_3$ was found when $AgNO_3$ was added to $2Z^1$ solution, $2Z^2$ solution and comparative solution-1 (a 0.45 wt % solution of polyacrylic acid having a polymerization degree of 500). The foregoing relationship as to $2Z^2$ solution was almost the same with that of comparative solution-1. Twenty (20) ml of $2Z^2$ solution was vacuum frozen-dried, powdered, and infrared absorption spectrum (FT-IR measurement) was measured, as a result, absorption peak of a sulfonyl group was not observed and only an absorption peak of a sulfinyl group was observed. From the above facts, it was judged that 100% of thioether groups of compound 2 was converted to sulfinyl groups.

EXAMPLE 4B

AgX emulsions were prepared in the same manner as in Example 4 except for using compound 11 in place of compound 2 in the equimolar amount. Each emulsion was desalted and dispersed again. TEM image of the replica of each of emulsion grains obtained was measured. The results obtained are shown in Table 2. Compound 11 was prepared as follows.

In a glass container was added 1.0 liter of a 6.0 wt % aqueous solution of compound 2 (40° C., pH was adjusted to 1.7 with $HNO_3$), and the temperature was raised to 90° C. One point five (1.5) ml of a 31 wt % solution of $H_2O_2$ was added and after mixing the solution homogeneously, the container was capped and maintained at 90° C. for 90 minutes. Ninety minutes after, the temperature was lowered to 40° C., a 3 N NaOH solution was added thereto and pH was adjusted to 6.0, and then $H_2O$ was added to make the total amount 1,200 g. An $MnO_2$ powder was added in an amount of 0.3 g, and the solution was stirred for 3 hours at 40° C. to decompose the remaining $H_2O_2$. The solution was centrifuged and the supernatant was taken out. The thus-obtained solution was designated $2Z^3$ solution. The necessary amount of $2Z^3$ solution was used for grain formation.

When the relationship between the silver potential and the addition amount of $AgNO_3$ was found as to 100 ml of $2Z^3$ solution, which was almost the same with that of comparative solution-1. Twenty (20) ml of $2Z^3$ solution was vacuum frozen-dried, powdered, and infrared absorption spectrum was measured, as a result, absorption peak of a sulfinyl group was not observed and only an absorption peak of a sulfonyl group was observed. From the above facts, it was judged that 100% of thioether groups of compound 2 was converted to sulfonyl groups.

EXAMPLE 4C

AgX emulsions were prepared in the same manner as in Example 4 except for using compound 12 in place of compound 3 in the equimolar amount. Each emulsion was desalted and dispersed again. TEM image of the replica of each of emulsion grains obtained was observed. The results obtained are shown in Table 2. Compound 12 was prepared as follows.

In a glass container was added 1.0 liter of a 6.0 wt % aqueous solution of compound 2 (40° C., pH: 4.0), then $7\times10^{-2}$ mol of $CH_3I$ was added, the container was capped and the solution was magnetically stirred for 7 hours at 40° C. Subsequently, the solution was allowed to stand under reduced pressure for 50 minutes without capping while continuing deaeration, thus the remaining $CH_3I$ was removed. $I^-$ was removed by electrodialysis. The obtained solution was designated $2Z^4$ solution. The necessary amount of $2Z^4$ solution was used for grain formation.

When the relationship between the silver potential and the addition amount of $AgNO_3$ was found as to 100 ml of $2Z^4$ solution, which was almost the same with that of comparative solution-1. As it is known from the first that $CH_3I$ alkylates a thioether group and forms sulfonium, it was judged that 100% of the thioether groups was converted to methylsulfonium.

Comparative Example 4

Comparative emulsion 4 was prepared in the same manner as in Example 4 except for using compound 1 in place of compound 2. The results obtained are shown in Table 2.

Each of emulsions obtained in Examples 1 to 4, 4A, 4B, 4C and Comparative Examples 1 to 4 was heated at 50° C., and an antifoggant was added to each emulsion in an amount of $2\times10^{-1}$ mol/mol-AgX, mixed for 15 minutes, then a thickener and a coating aid were added and coated with a protective layer on a TAC base. The coated web was dried, cut, thus a coated sample was obtained. Each coated sample was exposed for $10^{-2}$ sec. through a minus blue filter (transmitting light of 520 nm or more) and an optical wedge, developed, stopped, fixed, washed and dried. As an antifoggant, F1 was added to samples of Examples 1 to 3 and Comparative Examples 1 to 3. Development was conducted using MAA-1 developing solution (ref. *Journal of Photographic Science*, Vol. 23, pp. 249 to 256, (1975)) at 20° C. for 10 minutes. On the other hand, as an antifoggant, F2 was added to samples of Example 4, 4A, 4B, 4C and Comparative Example 4, and development was conducted using MAA-1 developing solution in which KBr was replaced with equimolar concentration of NaCl at 20° C. for 4 minutes.

Sensitometry of each sample was carried out. The results (relative value of sensitivity/graininess) obtained are shown in Table 2. The higher the relative value, the more excellent is the photographic property. Sensitivity is the reciprocal of the exposure amount giving the density of (fog+0.2). The sample was exposed uniformly by the exposure amount giving the density of (fog+0.2), developed, and graininess was obtained according to the method described in *The Theory of the Photographic Process*, p. 619, Macmillan. From the results obtained, the effect of the present invention was confirmed compared to comparative samples.

5 mV/min. using KBr-1 solution, then the reaction solution was ripened for 30 minutes.

TEM image of the replica of the emulsion grains picked at this point was observed. The results obtained were arranged by the same manner as in Table 2 and are shown in Table 3. Subsequently, a precipitant was added to the emulsion, and the emulsion was washed and dispersed again in the same manner as in Example 1.

TABLE 2

| | (a) | Average Aspect Ratio | Average Diameter (μm) | Variation Coefficient of Grain Size Distribution | Relative Value of Sensitivity/ Graininess | Fog Density |
|---|---|---|---|---|---|---|
| Example 1 | 97 | 13 | 0.85 | 12 | 115 | 0.07 |
| Comparative Example 1 | 88 | 8 | 0.90 | 25 | 100 | 0.16 |
| Example 2 | 96 | 13.2 | 0.86 | 13 | 120 | 0.08 |
| Comparative Example 2 | 87 | 9 | 0.91 | 27 | 100 | 0.17 |
| Example 3 | 95 | 20 | 1.3 | 19 | 118 | 0.07 |
| Comparative Example 3 | 88 | 15 | 1.32 | 30 | 100 | 0.16 |
| Example 4 | 95 | 10 | 1.05 | 15 | 116 | 0.11 |
| Comparative Example 4 | 89 | 6 | 1.1 | 25 | 100 | 0.20 |
| Example 4A | 96 | 10.8 | 1.10 | 14 | 119 | 0.10 |
| Example 4B | 96 | 10.6 | 1.08 | 14.6 | 118 | 0.10 |
| Example 4C | 96 | 10.5 | 1.08 | 14.3 | 117 | 0.10 |

The results of grain shape characteristics obtained from the observation of TEM images of samples obtained in Examples 2 to 4 and Comparative Examples 1 to 4 are also shown in Table 2.

EXAMPLE 5

In a reaction vessel was added a gelatin solution [containing 1,200 ml of $H_2O$, 25 g of alkali-processed ossein gelatin (BG-2) having a methionine content of 20 μmol/g, pH was adjusted to 6.5 with a 1 N NaOH solution], the temperature was maintained at 75° C., and silver potential was adjusted to 50 mV with KBr-1 solution and, with stirring, Ag-5 solution (containing 10 g of $AgNO_3$, 0.8 g of BG-2, and 0.21 ml of a 1 N $HNO_3$ in 100 ml of Ag-5 solution) and X-5 solution (containing 7.08 g of KBr, 0.8 g of BG-2 and a 0.21 ml of a 1 N NaOH solution in 100 ml of X-5 solution) were simultaneously added at a feeding rate of 7.0 ml/min. for 10 minutes, subsequently Ag-5 solution and X-5 solution were simultaneously added at an initial feeding rate of 3.5 ml/min. and an accelerated linear flow rate of 0.12 ml/min. for 90 minutes with maintaining silver potential of 50 mV.

After mixing the solution for 3 minutes, the temperature was lowered to 60° C. After adjusting pH to 6.5 and silver potential to 50 mv, gold sensitizer 1 was added in an amount of $0.9\times10^{-5}$ mol/mol-AgX, 2 minutes after the addition of gold sensitizer 1, chalcogenide sensitizer S×1 was added in an amount of $2.1\times10^{-5}$ mol/mol-AgX, and the solution was ripened for 30 minutes. Then, a gelatin dispersion of sensitizing dye 2 comprising the powder of sensitizing dye 2 (particle diameter: 1.0 μm or less) dispersed in a gelatin solution (2.0 wt %) was added in an amount of 80% of the saturation adsorption amount, and the solution was stirred for 30 minutes. pH was adjusted to 4.0 with phosphoric acid, and silver potential was lowered to 0 mV at a rate of about

EXAMPLE 5A

AgX emulsions were prepared in the same manner as in Example 5 except for using compound 11 in place of compound 2 in the equimolar amount. Each emulsion was desalted and dispersed again. TEM image of the replica of each of emulsion grains obtained was observed. The results obtained are shown in Table 3.

EXAMPLE 5B

AgX emulsions were prepared in the same manner as in Example 5 except for using compound 12 in place of compound 2 in the equimolar amount. Each emulsion was desalted and dispersed again. TEM image of the replica of each of emulsion grains obtained was observed. The results obtained are shown in Table 3.

EXAMPLE 5C

AgX emulsions were prepared in the same manner as in Example 5 except for using compound 13 in place of compound 2 in the equimolar amount. Each emulsion was desalted and dispersed again. TEM image of the replica of each of emulsion grains obtained was observed. The results obtained are shown in Table 3.

Comparative Example 5

AgX emulsions were prepared in the same manner as in Example 5 except for using compound 1 in place of compound 2 in the equimolar amount. Each emulsion was desalted and dispersed again. TEM image of the replica of each of emulsion grains obtained was observed. The results obtained are shown in Table 3.

Each of emulsions obtained in Examples 5, 5A, 5B, 5C and Comparative Example 5 was heated at 50° C., and an antifoggant was added to each emulsion in an amount of $2\times10^{-3}$ mol/mol-AgX, mixed for 15 minutes, then a thickener and a coating aid were added and coated with a protective layer on a TAC base. The coated web was dried, cut, thus a coated sample was obtained. Each coated sample was exposed for $10^{-2}$ sec. through a minus blue filter (transmitting light of 520 nm or more) and an optical wedge, developed, stopped, fixed, washed and dried. As an antifoggant, F1 was added to each sample. Development was conducted using MAA-1 developing solution (ref. *Journal of Photoqraphic Science*, Vol. 23, pp. 249 to 256, (1975)) at 20° C. for 10 minutes.

Sensitometry of each sample was carried out. The results (relative value of sensitivity/graininess) obtained are shown in Table 2. The results obtained were arranged by the same manner as in Table 2 and are shown in Table 3. From the results obtained, the effect of the present invention was confirmed compared to Comparative Example 5.

Application of emulsions obtained in Examples 1, 2, 3, 5, 5A, 5B and 5C (referred to as "Example BR") and emulsions obtained in Examples 4, 4A, 4B and 4C (referred to as "Example CL") to each product.

EXAMPLE 9

Application to X-ray

A sample was prepared in which the emulsion prepared in Example CL in the present invention was used in each layer of photographic material A in Example 1 of JP-A-9-329875 and processed in the same manner as in Example 1 of JP-A-9-329875. As a result, excellent results were obtained.

EXAMPLE 10

Application to Dry Color Negative Film

A sample was prepared in-which the emulsion prepared in Example BR in the present invention was used as a constitutional emulsion of Sample No. 101 in Example 1 of JP-A-10-62938 and processed in the same manner as in Example 1 of JP-A-10-62938. As a result, excellent results were obtained. Further, Sample Nol. 101 was prepared in which the emulsion prepared in Example CL in the present invention was used in place of emulsion A-1 in Example 1 of JP-A-10-62933 and processed in the same manner as in Example 1 of JP-A-10-62933. As a result, excellent results were obtained.

TABLE 3

| | (a) | Average Aspect Ratio | Average Diameter (μm) | Variation Coefficient of Grain Size Distribution | Relative Value of Sensitivity/ Graininess | Fog Density |
|---|---|---|---|---|---|---|
| Example 5 | 97 | 7.0 | 1.0 | 16 | 116 | 0.08 |
| Example 5A | 97 | 7.6 | 1.07 | 15 | 119 | 0.07 |
| Example 5B | 97 | 7.5 | 1.06 | 14.5 | 118 | 0.07 |
| Example 5C | 97 | 7.4 | 1.03 | 14.7 | 119 | 0.07 |
| Comparative Example 5 | 90 | 5.0 | 0.88 | 19 | 100 | 0.17 |

EXAMPLE 6

Application to a Color Negative Film

A sample was prepared in which the emulsion prepared in Example BR in the present invention was used in each emulsion layer of Sample No. 11. in Example 1 in JP-A-9-325450 and processed in the same manner as in Example 1 of JP-A-9-325450. As a result, excellent results were obtained.

EXAMPLE 7

Application to a Color Reversal Film

A sample was prepared in which the emulsion prepared in Example BR in the present invention was used in each emulsion layer of Sample No. 101 in Example 1 of JP-A-9-325446 and processed in the same manner as in Example 1 of JP-A-9-325446. As a result, excellent results were obtained.

EXAMPLE 8

Application to a Color Paper

A sample was prepared in which the emulsion prepared in Example CL in the present invention was used in the fifth layer of Sample No. 128 in Example 1 of JP-A-9-288336 and processed in the same manner as in Example 1 of JP-A-9-288336. As a result, excellent results were obtained.

EFFECT OF THE INVENTION

When an AgX emulsion according to the present invention is coated on a support in one or more layers and a photographic material is prepared, a photographic material having low fog density, excellent sensitivity and graininess can be obtained as compared with the case using the AgX emulsion in which a polyvinyl alcohol is used in place of compound $A^0$.

While the invention has been described in detail and with reference to specific examples thereof, it will be apparent to one skilled in the art that various changes and modifications can be made therein without departing from the spirit and scope thereof.

What is claimed is:

1. A silver halide emulsion comprising at least a dispersion medium and silver halide grains, wherein from 40 to 100% of the total projected area of the entire silver halide grains are occupied by tabular grains having a thickness of from 0.01 to 0.50 μm, an aspect ratio (diameter/thickness) of from 1.6 to 500, and main planes of {100} faces, and the aspect ratio of a right angled parallelogram surrounded by edge sides of {100} face of said tabular grains or a right angled parallelogram formed by extending said edge sides (long side length/short side length) is from 1 to 8, and said tabular grains are tabular grains formed by the adsorption of compound $A^0$ represented by formula $(Z^1)$, $(Z^2)$, $(Z^3)$ or $(Z^4)$ onto silver halide grains:

$$B^1—S—B^2 \quad (Z^1)$$

$$B^1—S(O)—B^2 \quad (Z^2)$$

$$B^1—S(O_2)—B^2 \quad (Z^3)$$

$$B^1—S^+(R^0)—B^2 \cdot Y_0^- \quad (Z^4)$$

wherein $B^1$ represents a residue having two or more repeating units of polyvinyl alcohol in $B^1$; —S— represents a thioether group; $B^2$ represents a residue having two or more repeating units of polyacrylic acid or polyacrylamide; $R^0$ represents an alkyl group having from 1 to 20 carbon atoms, an aryl group, or an amino group; and $Y_0^-$ represents an anion.

2. The silver halide emulsion as claimed in claim 1, wherein seed crystals of said tabular grains are formed by feeding $Ag^+$ and a halogen ion to an aqueous solution containing silver halide grains adsorbed with compound $A^0$, and said tabular grains are grown by depositing $Ag^+$ and a halogen ion onto said seed crystals.

3. The silver halide emulsion as claimed in claim 1, wherein said tabular grains are formed in a silver halide emulsion containing at least gelatin, water and silver halide grains adsorbed with compound $A^0$, and $x_1$ (the weight of compound $A^0$/the weight of the dispersion medium) in said emulsion is from $10^{-3}$ to 100.

* * * * *